US008596748B2

(12) United States Patent
Itogawa

(10) Patent No.: US 8,596,748 B2
(45) Date of Patent: Dec. 3, 2013

(54) LIQUID EJECTION APPARATUS USING PRECOAT LIQUID AND STORAGE MEDIUM STORING PROGRAM THEREFOR

(75) Inventor: Yoshihiro Itogawa, Gifu-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 191 days.

(21) Appl. No.: 13/072,540

(22) Filed: Mar. 25, 2011

(65) Prior Publication Data

US 2011/0242165 A1 Oct. 6, 2011

(30) Foreign Application Priority Data

Mar. 30, 2010 (JP) ..... 2010-078499
May 31, 2010 (JP) ..... 2010-125162

(51) Int. Cl.
*B41J 29/38* (2006.01)
*B41J 2/015* (2006.01)

(52) U.S. Cl.
USPC ..... 347/21; 347/5; 347/9; 347/12; 347/13; 347/14; 347/20

(58) Field of Classification Search
USPC ..... 347/5, 9, 21, 12–14, 20
See application file for complete search history.

(56) References Cited

U.S. PATENT DOCUMENTS 5,617,123 A * 4/1997 Takaoka et al. ..... 358/2.1
6,099,104 A * 8/2000 Sato et al. ..... 347/15
6,283,569 B1 * 9/2001 Otsuka et al. ..... 347/15
6,293,643 B1 * 9/2001 Shimada et al. ..... 347/15
6,328,400 B1 * 12/2001 Yonekubo et al. ..... 347/15
6,402,280 B2 * 6/2002 Kneezel et al. ..... 347/15
6,561,610 B2 * 5/2003 Yamasaki et al. ..... 347/15
6,565,191 B1 * 5/2003 Bolash et al. ..... 347/40
6,578,950 B2 * 6/2003 Matsumoto et al. ..... 347/42
7,357,472 B2 * 4/2008 Yamanobe ..... 347/15
7,588,305 B2 * 9/2009 Knierim et al. ..... 347/14

(Continued)

FOREIGN PATENT DOCUMENTS

JP H09-141841 A 6/1997
JP H09-300665 A 11/1997

(Continued)

OTHER PUBLICATIONS

Decision to Grant a Patent dated Jul. 31, 2012 from the Japanese Patent Office from related Japanese Application No. 2010-078499, together with an English-language translation.

*Primary Examiner* — Laura Martin
*Assistant Examiner* — Jeremy Bishop
(74) *Attorney, Agent, or Firm* — Scully, Scott, Murphy & Presser, PC

(57) ABSTRACT

A liquid ejection apparatus includes: a conveying mechanism, a first head for ejecting a first liquid; a second head for ejecting a second liquid for coagulating or precipitating components of the first liquid, and a controller. A pair of second ejection openings of the second head are arranged side by side. The second liquid is to be ejected respectively from the pair of second ejection openings at different timings onto a pair of unit areas arranged side by side. The controller controls the second head so as to reduce an amount of the second liquid ejected from at least one of the pair of second ejection openings, when an amount of the second liquid to be ejected from one of the pair of second ejection openings at an earlier one of the different timings is equal to or larger than a first predetermined value.

11 Claims, 16 Drawing Sheets

(56) References Cited

U.S. PATENT DOCUMENTS

| | | | | |
|---|---|---|---|---|
| 7,604,319 | B2 * | 10/2009 | Hirakawa | 347/21 |
| 7,628,481 | B2 * | 12/2009 | Kadomatsu et al. | 347/102 |
| 7,645,019 | B2 * | 1/2010 | Hirakawa | 347/21 |
| 2006/0203019 | A1 | 9/2006 | Yamanobe | |

FOREIGN PATENT DOCUMENTS

| | | |
|---|---|---|
| JP | 2006-248041 | 9/2006 |
| JP | 2007-111941 | 5/2007 |
| JP | 2008-012801 | 1/2008 |
| JP | 2008-265324 A | 11/2008 |

* cited by examiner

F: DROPLET TO BE EJECTED FIRST
L: DROPLET TO BE EJECTED LATER
(L): LARGE-SIZED DROPLET
(M): MEDIUM-SIZED DROPLET

F: DROPLET TO BE EJECTED FIRST
L: DROPLET TO BE EJECTED LATER
(L): LARGE-SIZED DROPLET
(M): MEDIUM-SIZED DROPLET

F: DROPLET TO BE EJECTED FIRST
L: DROPLET TO BE EJECTED LATER
(L): LARGE-SIZED DROPLET
(M): MEDIUM-SIZED DROPLET

F: DROPLET TO BE EJECTED FIRST
L: DROPLET TO BE EJECTED LATER
(L): LARGE-SIZED DROPLET
(M): MEDIUM-SIZED DROPLET

F: DROPLET TO BE EJECTED FIRST
L: DROPLET TO BE EJECTED LATER
(M): MEDIUM-SIZED DROPLET

LIQUID EJECTION APPARATUS USING PRECOAT LIQUID AND STORAGE MEDIUM STORING PROGRAM THEREFOR

CROSS REFERENCE TO RELATED APPLICATION

The present application claims priority from Japanese Patent Application Nos. 2010-078499 filed on Mar. 30, 2010, and 2010-125162 filed on May 31, the disclosure of which is herein incorporated by reference in its entirety.

BACKGROUND OF THE INVENTION

1. Field of the Invention

The present invention relates to a liquid ejection apparatus configured to eject first liquid from ejection openings onto a recording medium after ejecting second liquid for coagulating or precipitating components of the first liquid, and relates to a storage medium storing a program executed in the liquid ejection apparatus.

2. Description of the Related Art

There is known a line ink-jet printer configured to eject pretreatment liquid for coagulating or precipitating color components of ink, onto a position at which a dot is to be formed on a sheet, before ejecting an ink droplet, in order to reduce spreading of the dot.

SUMMARY OF THE INVENTION

Where nozzles for ejecting the pretreatment liquid are adjacent to each other in a main scanning direction perpendicular to a sheet conveying direction and are arranged at different positions in the sheet conveying direction, timings for ejecting the pretreatment liquid are different from each other between two pixel areas arranged at the same position on the sheet in the sheet conveying direction and adjacent to each other in the main scanning direction in a recording resolution. In this case, pretreatment liquid ejected first onto one pixel area may spread over pixel areas adjacent to the one pixel area, whereby pretreatment liquid ejected thereafter may be unfortunately overlaid on an area over which the pretreatment liquid ejected first has spread, before the pretreatment liquid ejected first has been landed and permeated the sheet. In this overlaying area, the pretreatment liquid ejected later tends not to sufficiently permeate the sheet and tends to remain in a liquid-layer state. Thus, when the ejected ink has been landed on the pretreatment liquid in the liquid-layer state, the ink forms a dot having a size smaller than a desired size and having a relatively high density. This may cause streaks and density inconsistencies on a recorded image, lowering a recording quality.

This invention has been developed in view of the above-described situations, and it is an object of the present invention to provide a liquid ejection apparatus and a storage medium storing a program executed in the liquid ejection apparatus which can prevent occurrence of streaks and density inconsistencies on a recorded image.

The object indicated above may be achieved according to the present invention which provides a liquid ejection apparatus, comprising: a conveying mechanism configured to convey a recording medium in a predetermined conveying direction, a first-liquid ejection head having a plurality of first ejection openings formed therein for ejecting first liquid to form an image on the recording medium; a second-liquid ejection head having a plurality of second ejection openings formed therein for ejecting second liquid having a property of coagulating or precipitating components of the first liquid, the second-liquid ejection head being disposed upstream of the first-liquid ejection head in the conveying direction; and a controller configured to control the first-liquid ejection head and the second-liquid ejection head, wherein the plurality of second ejection openings of the second-liquid ejection head include a pair of second ejection openings arranged side by side in a perpendicular direction perpendicular to the conveying direction and respectively arranged at different positions in the conveying direction, wherein the recording medium is separated into a plurality of unit areas along the conveying direction and the perpendicular direction, the plurality of unit areas respectively corresponding to a plurality of pixels defined by a resolution of the image, wherein the plurality of unit areas includes a pair of unit areas onto which the second liquid is to be ejected respectively from the pair of second ejection openings at different timings, the pair of unit areas being located at the same position in the conveying direction and arranged side by side in the perpendicular direction, and wherein the controller is configured to control the second-liquid ejection head so as to reduce an amount of the second liquid to be ejected from at least one of the pair of second ejection openings, where an amount of the second liquid to be ejected from one of the pair of second ejection openings at an earlier one of the different timings is equal to or larger than a first predetermined value.

The object indicated above may be achieved according to the present invention which provides a storage medium storing a program executed in a liquid ejection apparatus, the apparatus including: a conveying mechanism configured to convey a recording medium in a predetermined conveying direction, a first-liquid ejection head having a plurality of first ejection openings formed therein for ejecting first liquid to form an image on the recording medium; a second-liquid ejection head having a plurality of second ejection openings formed therein for ejecting second liquid having a property of coagulating or precipitating components of the first liquid, the second-liquid ejection head being disposed upstream of the first-liquid ejection head in the conveying direction; and a controller configured to control the first-liquid ejection head and the second-liquid ejection head, wherein the plurality of second ejection openings of the second-liquid ejection head include a pair of second ejection openings arranged side by side in a perpendicular direction perpendicular to the conveying direction and respectively arranged at different positions in the conveying direction, wherein the recording medium is separated into a plurality of unit areas along the conveying direction and the perpendicular direction, the plurality of unit areas respectively corresponding to a plurality of pixels defined by a resolution of the image, wherein the plurality of unit areas includes a pair of unit areas onto which the second liquid is to be ejected respectively from the pair of second ejection openings at different timings, the pair of unit areas being located at the same position in the conveying direction and arranged side by side in the perpendicular direction, and wherein the program comprises controlling the second-liquid ejection head so as to reduce an amount of the second liquid to be ejected from at least one of the pair of second ejection openings, where an amount of the second liquid to be ejected from one of the pair of second ejection openings at an earlier one of the different timings is equal to or larger than a first predetermined value.

The object indicated above may be achieved according to the present invention which provides a storage medium storing a program executed in a liquid ejection apparatus, the apparatus including: a conveying mechanism configured to convey a recording medium in a predetermined conveying direction, a first-liquid ejection head having a plurality of first ejection openings formed therein for ejecting first liquid to form an image on the recording medium; a second-liquid ejection head having a plurality of second ejection openings formed therein for ejecting second liquid having a property of coagulating or precipitating components of the first liquid, the second-liquid ejection head being disposed upstream of the first-liquid ejection head in the conveying direction; and a controller configured to control the first-liquid ejection head and the second-liquid ejection head, wherein the plurality of second ejection openings of the second-liquid ejection head include a pair of second ejection openings arranged side by side in a perpendicular direction perpendicular to the conveying direction and respectively arranged at different positions in the conveying direction, wherein the recording medium is separated into a plurality of unit areas along the conveying direction and the perpendicular direction, the plurality of unit areas respectively corresponding to a plurality of pixels defined by a resolution of the image, wherein the plurality of unit areas includes a pair of unit areas onto which the second liquid is to be ejected respectively from the pair of second ejection openings at different timings, the pair of unit areas being located at the same position in the conveying direction and arranged side by side in the perpendicular direction, and wherein the program comprises controlling the second-liquid ejection head such that an amount of the second liquid to be ejected from one of the pair of second ejection openings at an earlier one of the different timings is equal to or smaller than the first predetermined value that is an amount of the second liquid in which, at a time when or after the second liquid has been landed on one of the unit areas, the second liquid does not reach another unit area next to the unit area on which the second liquid has been landed, and such that an amount of the second liquid to be ejected from the other of the pair of second ejection openings at a timing later than the early timing is equal to or smaller than a second predetermined value that is an amount of the second liquid in which, at a time when the second liquid has been landed on one of the unit areas, the second liquid does not reach another unit area next to the unit area on which the second liquid has been landed.

In the image recording apparatus constructed as described above, it is possible to prevent that, before the second liquid ejected later from the second ejection opening of the pair of second ejection openings sufficiently permeates the recording medium, the second liquid ejected later is overlaid, on the recording medium, on the second liquid ejected first from the second ejection opening of the pair of second ejection openings. As a result, both of the second liquids ejected respectively from the second ejection openings sufficiently permeate the recording medium and expand or spread over their respective desired areas, reducing an area of the second liquid remaining in a liquid-layer state. Thus, when the ejected first liquid has been landed on the second liquid, the first liquid forms a dot having desired size and density. Accordingly, streaks and inconsistencies in density are less likely to occur on the recorded image, thereby preventing a lowering of an image quality.

BRIEF DESCRIPTION OF THE DRAWINGS

The objects, features, advantages, and technical and industrial significance of the present invention will be better understood by reading the following detailed description of embodiments of the invention, when considered in connection with the accompanying drawings, in which.

DETAILED DESCRIPTION OF THE EMBODIMENTS

Hereinafter, there will be described embodiments of the present invention by reference to the drawings.

First Embodiment

Figure 1:
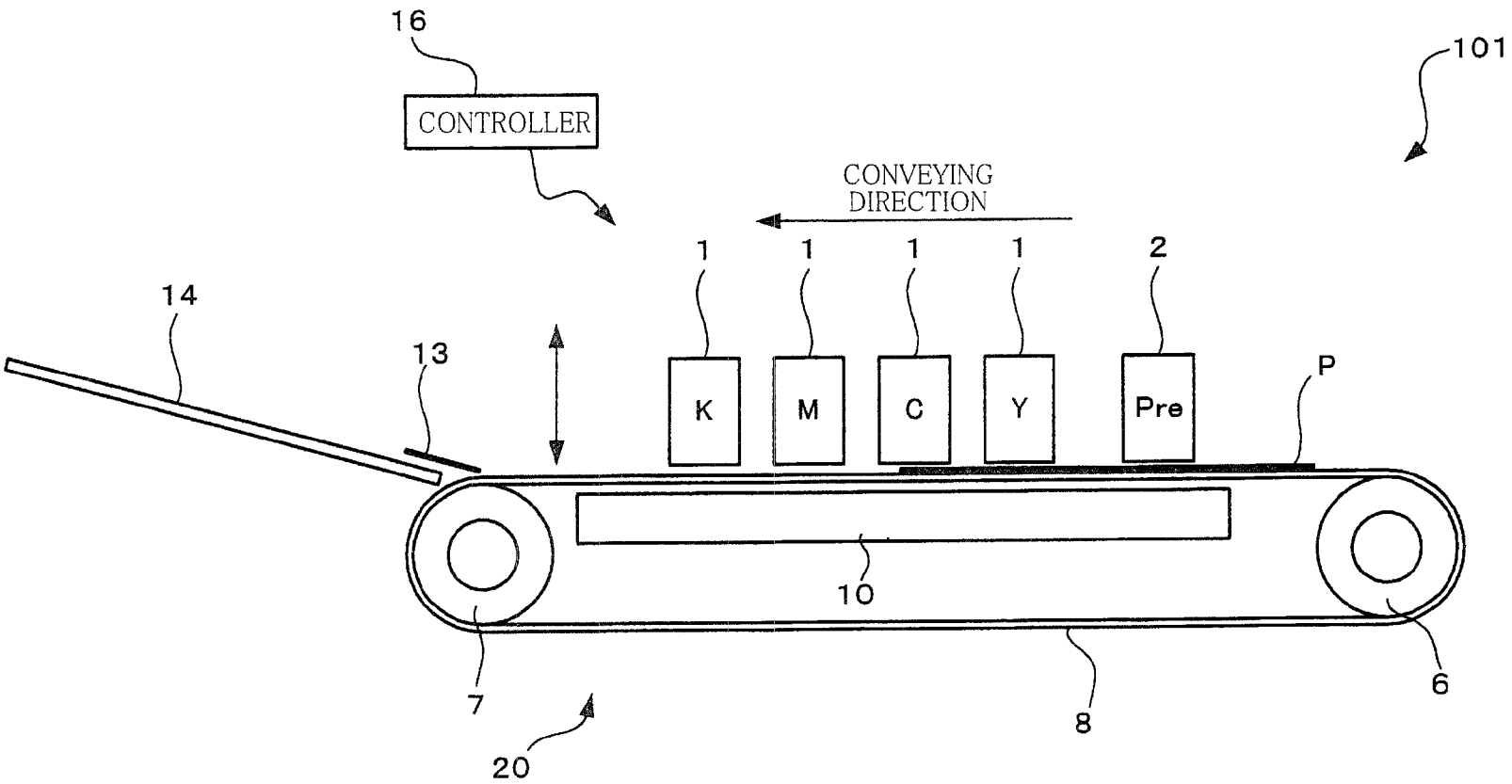
FIG. 1 is a side view generally showing an ink-jet printer as a first embodiment in the present invention.

As shown in FIG. 1, an ink-jet printer 101 includes a sheet-convey unit 20 as one example of a conveying mechanism, four ink-jet heads 1 each as one example of a first-liquid ejection head, a precoat head 2 as one example of a second-liquid ejection head, and a controller 16. The sheet-convey unit 20 is configured to convey or feed a sheet P from a right side toward a left side in FIG. 1. The ink-jet heads 1 are configured to eject ink droplets onto the sheet P conveyed by the sheet-convey unit 20. Specifically, the ink-jet heads 1 respectively eject inks (as one example of first liquid) of respective four colors, namely, yellow (Y), cyan (C), magenta (M), and black (K). The precoat head 2 is configured to eject liquid droplets of precoat liquid (Pre) as one example of second liquid. The precoat liquid has a property of coagulating or precipitating color components (pigment compositions) of each ink. The controller 16 is configured to control entire operations of the ink jet printer 101. It is noted that, in the present embodiment, a sub-scanning direction is a direction parallel to a conveying direction in which the sheet P is conveyed by the sheet-convey unit 20, and a main scanning direction is a direction perpendicular to the sub-scanning direction and the conveying direction and along a horizontal plane. For pigment ink, precoat liquid for coagulating pigment color components is used. For dye ink, precoat liquid for precipitating dye color components is used. The precoat liquid is formed of a material such as liquid containing a cationic high polymer, liquid containing a polyvalent metal salt such as magnesium salt, and the like. When the ink is landed on or attached to a region of the sheet P to which such precoat liquid has been applied in advance, the polyvalent metal salt and so on react with dyes or pigments as coloring agent of the ink, thereby forming an insoluble or hardly soluble metal complex and so on by the coagulation or precipitation. As a result, a degree of a penetration or a permeation of the attached ink into the sheet P is lowered, making it easier to fix the ink onto the sheet P.

The sheet-convey unit 20 includes belt rollers 6, 7 and an endless sheet-convey belt 8 wound around the rollers 6, 7. The belt roller 7 is a drive roller which is rotated in a counterclockwise direction in FIG. 1 by a drive power of a sheet-convey motor, not shown. The belt roller 6 is a driven roller which is rotated in accordance with the rotation of the sheet-convey belt 8. A silicon layer having a low viscosity is formed on an outer circumferential face of the sheet-convey belt 8 to support or hold the sheet P placed thereon. The sheet P placed on the outer circumferential face of the sheet-convey belt 8 is conveyed toward the left side in FIG. 1. A peeling plate 13 is disposed on a downstream side of the four ink-jet heads 1 in the conveying direction. While being conveyed in the conveying direction, the sheet P passes through positions just under the precoat head 2 and the four ink-jet heads 1 in order. The sheet P is then peeled off from the outer circumferential face of the sheet-convey belt 8 by the peeling plate 13 and then discharged onto a sheet-discharge tray 14 disposed on a left side of the sheet-convey belt 8 in FIG. 1. A platen 10 is disposed so as to face the four ink-jet heads 1 and the precoat head 2 and supports an upper portion of the sheet-convey belt 8 from an inside thereof. As a result, a specific space appropriate for image recording is defined between the outer circumferential face of the sheet-convey belt 8 and the respective ejection faces of the four ink-jet heads 1 and the precoat head 2.

The four ink-jet heads 1 and the precoat head 2 have the same construction. The ink-jet heads 1 and the precoat head 2 extend in the main scanning direction and are arranged in parallel in the sub-scanning direction. The precoat head 2 is disposed on an upstream side of the four ink jet heads 1 in the conveying direction. A lower face of each of the ink-jet heads 1 and the precoat head 2 functions as an ejection face in which are formed and arranged a multiplicity of ejection openings 108*a*, 108*b* (see FIG. 2). That is, the ink-jet printer 101 is a line color ink-jet printer having the ejection openings 108*a*, 108*b* arranged in the main scanning direction and opened for ejecting the ink droplets. It is noted that each of the ejection openings 108*a*, 108*b* of each ink-jet head 1 is one example of a first ejection opening, and each of the ejection openings 108*a*, 108*b* of the precoat head 2 is one example of a second ejection opening.

The outer circumferential face of the upper portion of the sheet-convey belt 8 and the ejection faces face each other so as to be parallel to each other. When the sheet P conveyed by the sheet-convey belt 8 passes through the position just under the precoat head 2, the precoat head 2 ejects the precoat liquid droplets onto the sheet P such that the precoat liquid is applied to an image-recorded area of an upper face of the sheet P. Then, when the sheet P passes through the positions just under the respective four ink-jet heads 1, the ink-jet heads 1 eject the ink droplets of the respective colors in order onto the precoat-liquid applied area of the upper face of the sheet P. As a result, a desired color image is recorded on the sheet P. In this image recording operation, when the ink droplet has been landed on the precoat liquid applied on the sheet P, the precoat liquid coagulates or precipitates the color component of the ink droplet, thereby preventing the ink from spreading on the sheet P.

Figure 2:
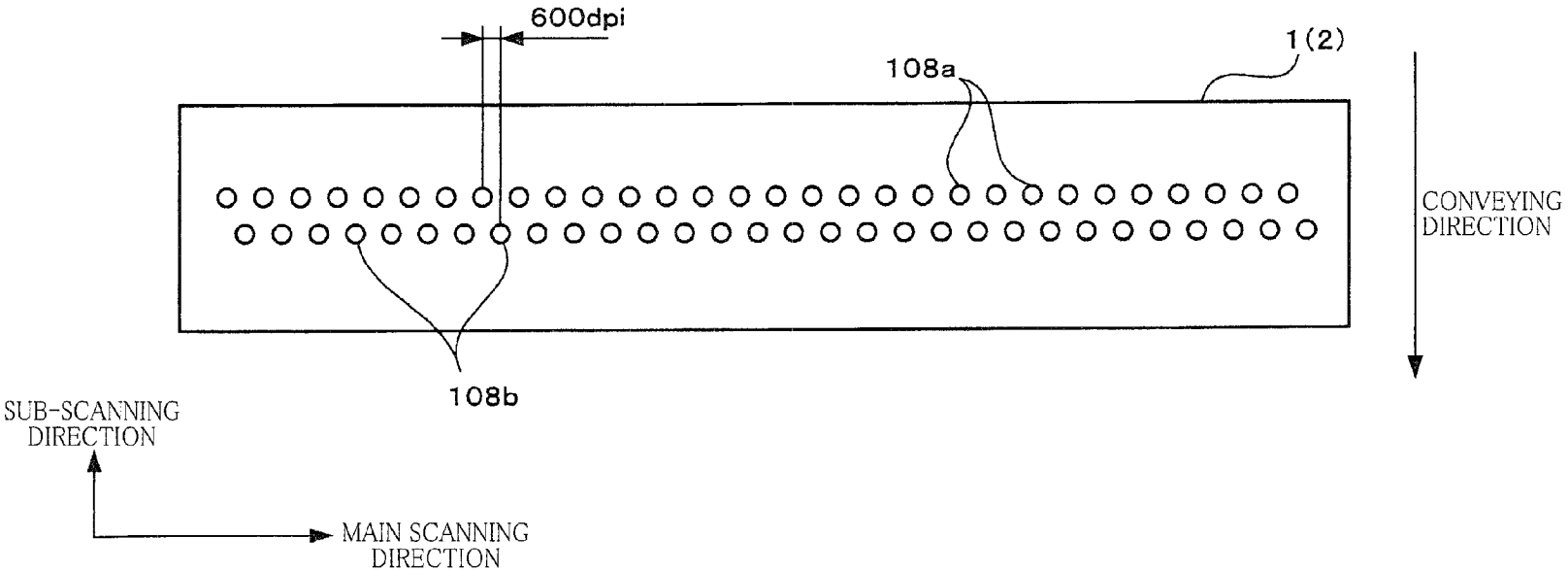
FIG. 2 is a plan view showing an ejection face of an ink-jet head shown in FIG. 1.

There will be next explained the ink-jet heads 1 and the precoat head 2 in detail. It is noted that the precoat head 2 substantially has the same construction of the ink-jet heads 1, and thus the explanation thereof is omitted. Further, since the four ink-jet heads 1 have the same construction, the following explanation will be given for one of the ink-jet heads 1 for the sake of simplicity. As described above, the ink-jet head 1 as the lower face as the ejection face in which are formed the ejection openings 108*a*, 108*b*. As shown in FIG. 2, in the ejection face, the plurality of the ejection openings 108*a*, 108*b* are arranged in a staggered fashion at pitches of 600 dpi in the main scanning direction. In other words, each two of the ejection openings 108*a*, 108*b*, which two are adjacent to each other in the main scanning direction, are located at positions different from each other in the sub-scanning direction. Each of the plurality of the ejection openings 108*a* arranged in the main scanning direction is located on an upstream side, in the conveying direction (the sub-scanning direction), of a corresponding adjacent one of the plurality of the ejection openings 108*b* arranged in the main scanning direction. As a result, the ejection openings 108*a*, 108*b* are alternately arranged one by one in the main scanning direction. When the image is recorded or formed on the sheet P, the ink droplets ejected from the ejection openings 108*a* are landed on the sheet P, and then the ink droplets ejected from the ejection openings 108*b* landed on the sheet P.

Figure 3:
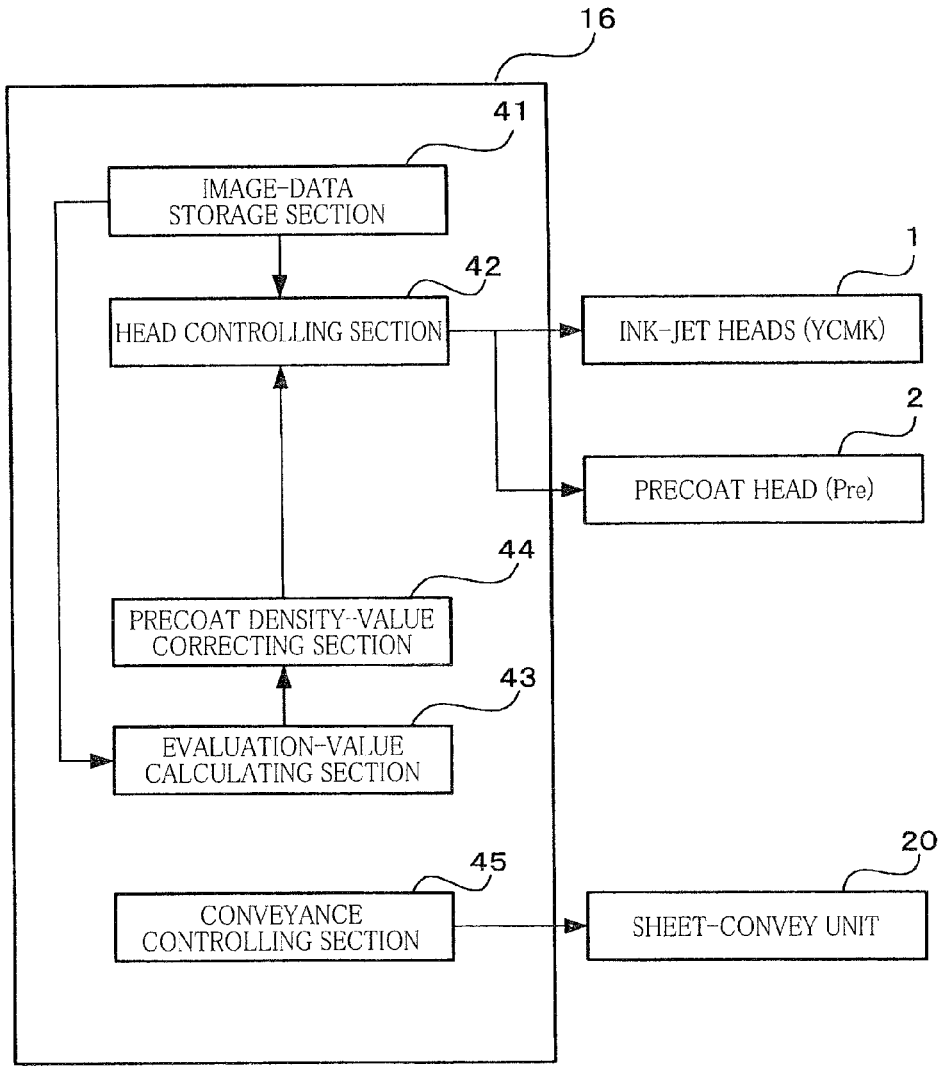
FIG. 3 is a block diagram of a controller shown in FIG. 1.

There will be next explained the controller 16. The controller 16 includes a Central Processing Unit (CPU), an Electrically Erasable and Programmable Read Only Memory (EEPROM) for rewritably storing programs executed by the CPU and data used for the programs, and a Random Access Memory (RAM) for temporarily storing data during execution of the programs. The controller 16 includes various functioning sections which are constituted by cooperation of these hardwares and softwares in the EEPROM with each other. Specifically, as shown in FIG. 3, the controller 16 includes a conveyance controlling section 45, an image-data storage section 41, a head controlling section 42, an evaluation-value calculating section 43, and a precoat density-value correcting section 44 as one example of a second-liquid-amount correcting section.

The conveyance controlling section 45 controls the sheet-convey motor of the sheet-convey unit 20 to convey the sheet P in the conveying direction. The image-data storage section 41 stores therein image data based on which the image is recorded on the sheet P. The image data has a density value of each of the inks (yellow, cyan, magenta, black) and the precoat liquid for each of a plurality of pixels (unit areas) which correspond to a resolution of the image and into which a surface of the sheet P is divided in the conveying direction and the main scanning direction. Each density value is quantized into four values respectively corresponding to non-ejection, a small-sized droplet, a medium-sized droplet and a large-sized droplet.

Figure 4:
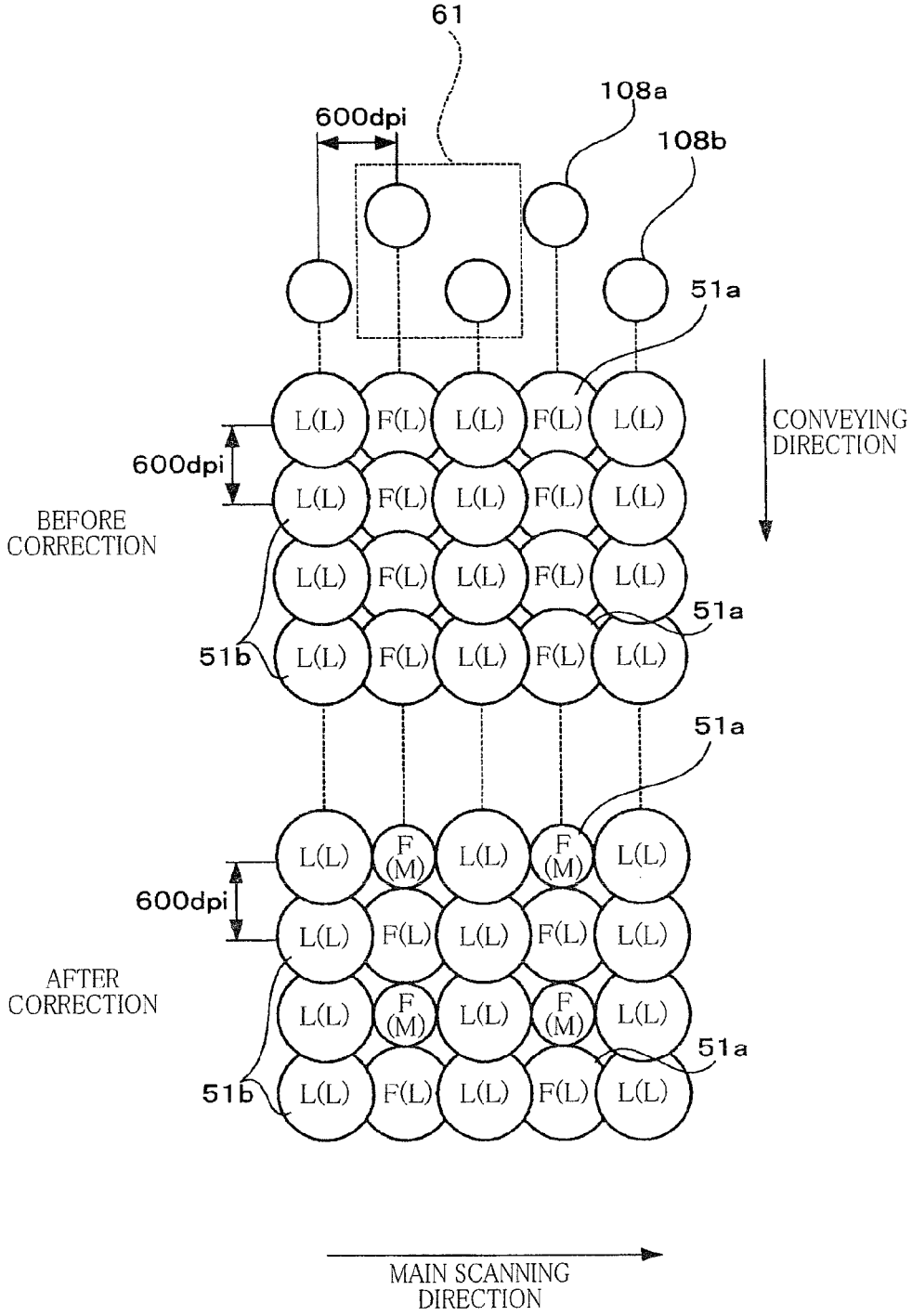
FIG. 4 is a view for explaining a function of a precoat density-value correcting section shown in FIG. 3.

The plurality of pixels are arranged in the main scanning direction to form a plurality of pixel rows. The evaluation-value calculating section 43 defines a plurality of pixel pairs each constituted by two pixels adjacent to each other in the main scanning direction in each of odd-numberth (in the conveying direction) pixel rows among the plurality of pixel rows. It is noted that even-numberth pixel rows may be used. As described above, the ejection openings 108*a*, 108*b* are arranged alternately in the main scanning direction. Thus, as shown in FIG. 4, one pixel of each of the pixel pairs corresponds to the ejection opening 108*a*, and the other pixel of each pixel pair corresponds to the ejection opening 108*b*. The evaluation-value calculating section 43 sets the ejection opening 108*a* and the ejection opening 108*b* respectively corresponding to the pixels of each pixel pair, as an ejection-opening pair 61 associated with the pixel pair.

Where an amount of the precoat liquid ejected from an ejection opening for ejecting the liquid first in each pixel pair (an ejection opening for ejecting the liquid at an earlier timing than a timing at which the liquid is ejected the other ejection opening of the pixel pair), i.e., the ejection opening 108*a*, is equal to or larger than a predetermined amount or a first predetermined value (the large droplet in the present embodiment), the evaluation-value calculating section 43 calculates, as an evaluation value for the pixel pair, an area in which precoat dots 51*a*, 51*b* to be formed respectively for the pixels of the pixel pair are overlaid on or overlap with each other. Specifically, for the pixel pair, the evaluation-value calculating section 43 obtains an elapsed time from landing of the precoat liquid ejected first from the ejection opening 108*a* on the sheet P, to landing of the precoat liquid ejected thereafter from the ejection opening 108*b* on the sheet P. This elapsed time corresponds to a length of time required for the sheet P to be conveyed or moved by a distance from the ejection opening 108*a* to the ejection opening 108*b* in the conveying direction. In a period until the precoat liquid landed on the sheet P completely penetrates or permeates the sheet P, the longer the elapsed time, the larger an area of the precoat dots 51*a* becomes because the precoat liquid landed on the sheet P permeates the sheet P. The evaluation-value calculating section 43 has a table in which a density value of the precoat liquid (may be hereinafter referred to as a "precoat-liquid density value") and the elapsed time are associated with each of areas of the respective precoat dots. By referring to this table, the evaluation-value calculating section 43 obtains the area of the precoat dot 51*a* on the basis of the elapsed time and the precoat-liquid density value (amount) for the precoat dot 51*a* to be formed for a pixel, which value has been obtained from the image data. Further, the evaluation-value calculating section 43 obtains the area of the precoat dot 51*b* on the basis of the precoat-liquid density value (amount) of the precoat dot 51*b* to be formed for a pixel, which value has been obtained from the image data. The evaluation-value calculating section 43 calculates the area in which the precoat dots 51*a*, 51*b* are overlaid on each other, as the evaluation value on the basis of the areas and positions of the respective precoat dots 51*a*, 51*b*. It is noted that this printer 101 may be configured such that the evaluation-value calculating section 43 obtains the evaluation value of the pixel pair directly from the table in which the elapsed time and the precoat-liquid density value for each pixel of the pixel pair are associated with the evaluation value. It is noted that, in the present embodiment and embodiments which will be described below, the amount of the precoat liquid ejected from the ejection openings 108*a* and 108*b* is determined in advance before a correction processing for correcting density values of the precoat liquid is performed by the precoat density-value correcting section 44 which will be described below. For example, in the first embodiment, the predetermined amount of the precoat liquid to be ejected from each of all the ejection openings 108*a* and 108*b* can be set at the same density (the large droplet in the present embodiment) as in the case of "BEFORE CORRECTION" in FIG. 4. Further, instead of this manner, the predetermined amount of the precoat liquid to be ejected from the ejection openings 108*a* and 108*b* can be set at an amount which is proportional to a largest ink density of the pixel for which the precoat liquid is to be ejected. In this case, the amount of the precoat liquid to be ejected from the ejection openings 108*a* and 108*b* can also be set at an amount which is proportional to a largest ink density of the pixel for which the precoat liquid is to be ejected, in a range not exceeding the density of the large droplet. It is noted that a precoat-liquid density value (an amount of the precoat liquid) temporarily determined in a fourth embodiment (which will be described below) is also the predetermined amount of the precoat liquid.

The precoat density-value correcting section 44 performs the correction processing for correcting density values of the precoat liquid relating to the image data stored in the image-data storage section 41. In this correction processing, where the evaluation value calculated by the evaluation-value calculating section 43 is equal to or larger than a predetermined value (i.e., a third predetermined value), the precoat density-value correcting section 44 reduces, from a predetermined amount, the precoat-liquid density value for the pixel corresponding to the precoat liquid ejected first from the ejection opening 108*a*, in the pixel pair having the evaluation value such that the evaluation value, i.e., the area in which the precoat dots 51*a*, 51*b* are overlaid on each other is smaller than the predetermined value. That is, the precoat density-value correcting section 44 reduces the amount of the precoat liquid ejected from the ejection opening 108*a* of the ejection-opening pair 61. It is noted that FIG. 4 shows an example in which the precoat density-value correcting section 44 has reduced the density values such that the medium droplets are to be ejected instead of the large droplets. Since the above-described correction processing is performed only for the odd-numberth pixel rows, pixels respectively corresponding to the reduced density values of the precoat liquid are never located adjacent to each other in the conveying direction. Further, with attention to two ejection-opening pairs 61 sharing the same ejection openings 108*a*, 108*b* and contiguous or adjacent to each other in the main scanning direction, pixels each corresponding to the precoat liquid having a reduced amount are not adjacent to each other in the main scanning direction among a plurality of pixels corresponding to each of the ejection openings 108*a*, 108*b*. As a result, it is possible to prevent that areas lacking the precoat liquid are contiguous to each other in the conveying direction.

Returning to the explanation of FIG. 3, after the completion of the above-described correction processing, the head controlling section 42, on the basis of the image data stored in the image-data storage section 41, controls the precoat head 2 such that the precoat liquid droplets having specific volumes are ejected from the ejection openings 108*a*, 108*b* at specific timings and controls each ink-jet head 1 such that the ink droplets having specific volumes are ejected from the ejection openings 108*a*, 108*b* at specific timings.

Figure 5:
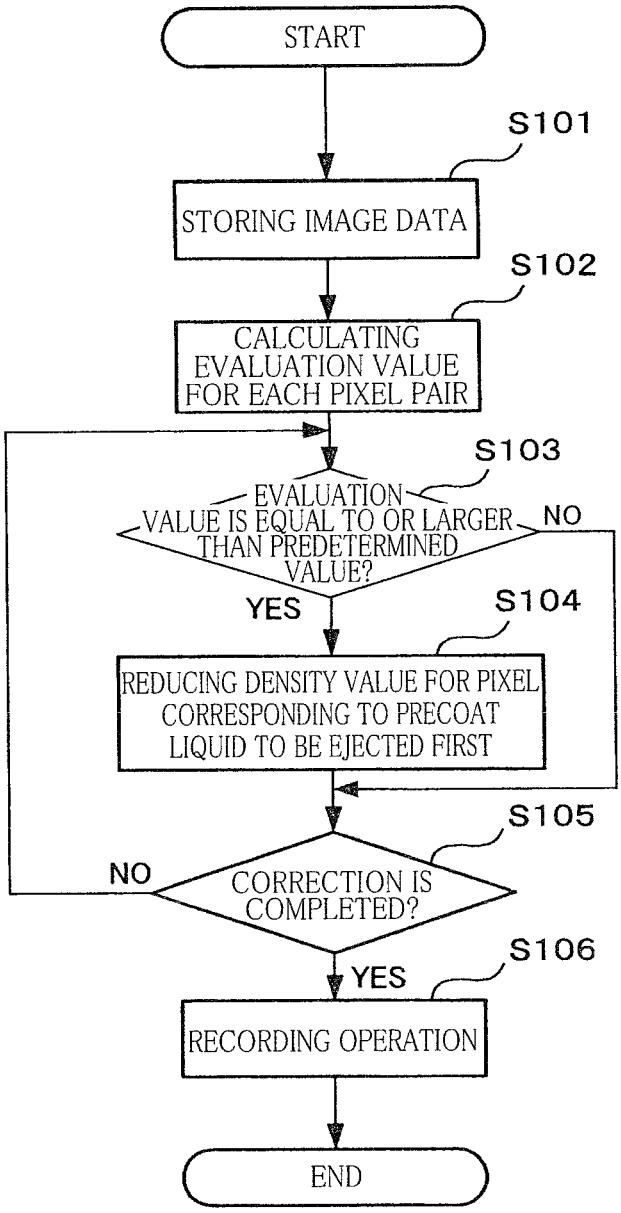
FIG. 5 is a flow-chart showing a recording operation of the ink-jet printer shown in FIG. 1.

There will be next explained the recording operation of the ink-jet printer 101. As shown in FIG. 5, initially in S101, when the ink-jet printer 101 has received image data and a recording command from an external computer, the received image data is stored into the image-data storage section 41. The evaluation-value calculating section 43 defines pixel pairs in each of odd-numberth (in the conveying direction) pixel rows. Further, in S102, the evaluation-value calculating section 43 calculates the evaluation value for each pixel pair in which the amount of the precoat liquid to be ejected from the ejection opening 108*a* corresponds to the large droplet among the defined pixel pairs. Where the evaluation value calculated by the evaluation-value calculating section 43 is equal to or larger than the predetermined value (S103: YES), the precoat density-value correcting section 44 in S104 reduces a precoat-liquid density value for a pixel corresponding to the ejection opening 108*a* among the pixel pair having the evaluation value such that the evaluation value becomes smaller than the predetermined value. The precoat density-value correcting section 44 repeats the above-described processings until the correction of the precoat-liquid density values has been completed for all the pixel pairs for which the evaluation-value calculating section 43 has calculated the respective evaluation values (S105: NO).

Where the correction of the precoat-liquid density values has been completed for all the pixel pairs (S105: YES), the head controlling section 42 in 5106 controls the precoat head 2 and each ink-jet head 1 to respectively eject the precoat liquid and the ink droplets onto the sheet P on the basis of the image data corrected by the precoat density-value correcting section 44, and the recording operation is finished (the processing in the flow-chart in FIG. 5 is finished).

In view of the above, in the ink-jet printer 101 of the present embodiment, the correction processing is performed for each pixel pair whose precoat dots 51*a*, 51*b* are overlaid on each other at the area equal to or larger than the predetermined value, such that the amount of the precoat liquid to be ejected from the ejection opening 108*a* is reduced. Accordingly, it is possible to prevent that, before the precoat liquid ejected later from the ejection opening 108*b* of the ejection-opening pair 61 (i.e., the precoat liquid ejected at a timing later than a timing at which the liquid is ejected from the ejection opening 108*a* of the ejection-opening pair 61) sufficiently permeates the sheet P, the precoat liquid ejected later is overlaid, on the sheet P, on the precoat liquid ejected first from the ejection opening 108*a* of the ejection-opening pair 61. As a result, both of the precoat liquids ejected respectively from the ejection openings 108*a*, 108*b* sufficiently permeate the sheet P and expand or spread over their respective desired areas, reducing an area of the precoat liquid remaining in a liquid-layer state. Thus, when the ejected ink has been landed on the precoat liquid, the ink forms a dot having desired size and density. Accordingly, streaks and inconsistencies in density are less likely to occur on the recorded image, thereby preventing a lowering of an image quality.

Further, where the evaluation value calculated by the evaluation-value calculating section 43 is equal to or larger than the predetermined value, the precoat density-value correcting section 44 reduces the precoat-liquid density value for the pixel corresponding to the ejection opening 108*a* in the pixel pair having the evaluation value such that the evaluation value becomes smaller than the predetermined value. Thus, the area in which the precoat dots 51*a*, 51*b* to be formed for the respective pixels of the pixel pair are overlaid on each other reliably becomes smaller than the predetermined value. Accordingly, it is possible to reliably prevent that, before the precoat liquid ejected later sufficiently permeates the sheet P, the precoat liquid ejected later is overlaid on the precoat liquid ejected first.

Further, in this printer 101, the precoat density-value correcting section 44 reduces the density value of the precoat liquid for the pixel corresponding to the ejection opening 108*a* in the pixel pair such that the amount of the precoat liquid ejected from the ejection opening 108*a* earlier among the two ejection openings 108*a*, 108*b* relating to the ejection-opening pair 61 is reduced. Accordingly, it is possible to prevent that the precoat liquid ejected first in the pixel pair spreads over an relatively wide area with a lapse of time. As a result, it is possible to efficiently prevent that, before the precoat liquid ejected later sufficiently permeates the sheet P, the precoat liquid ejected later is overlaid on the precoat liquid ejected first.

Figure 6:
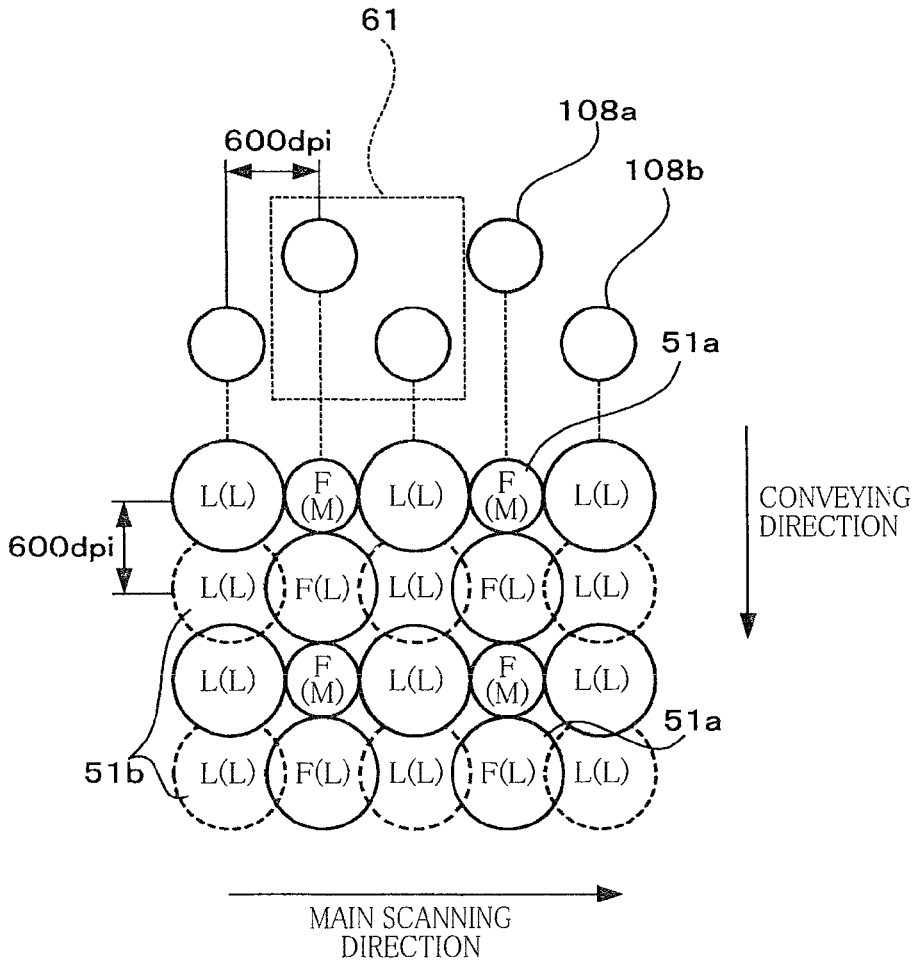
FIG. 6 is a view for explaining a modification of the first embodiment.

In addition, in this printer 101, the pixels respectively corresponding to the reduced density values are never adjacent to each other in the conveying direction and the main scanning direction. Thus, it is possible to prevent the amount of the precoat liquid from being partly lacked on the sheet P. Further, the pixels associated with the reduced amount of the precoat liquid are not contiguous to each other in the conveying direction, making it possible to prevent streaks from occurring in the conveying direction on the recorded image. cl Modification In the present embodiment, the precoat density-value correcting section 44 reduces the density values of the precoat liquid only for the pixels in each of the odd-numberth pixel rows. However, as shown in FIG. 6, the precoat density-value correcting section 44 may further reduce the precoat-liquid density value for the pixel corresponding to the precoat liquid ejected later from the ejection opening 108*b* in each pixel pair in even-numberth pixel rows in the conveying direction. It is noted that, in FIG. 6, each of the precoat-liquid density values for the respective pixels is reduced from the large droplet to zero (0), thereby changing each of the amounts of the precoat liquid to be ejected for the respective pixels from the ejection openings 108*b* to zero (indicated by dot lines).

As a result, it is possible to prevent that before the precoat liquid ejected later sufficiently permeates the sheet P, the precoat liquid ejected later is overlaid on the precoat liquid ejected first in the even-numberth pixel rows.

Second Embodiment

Figure 7:
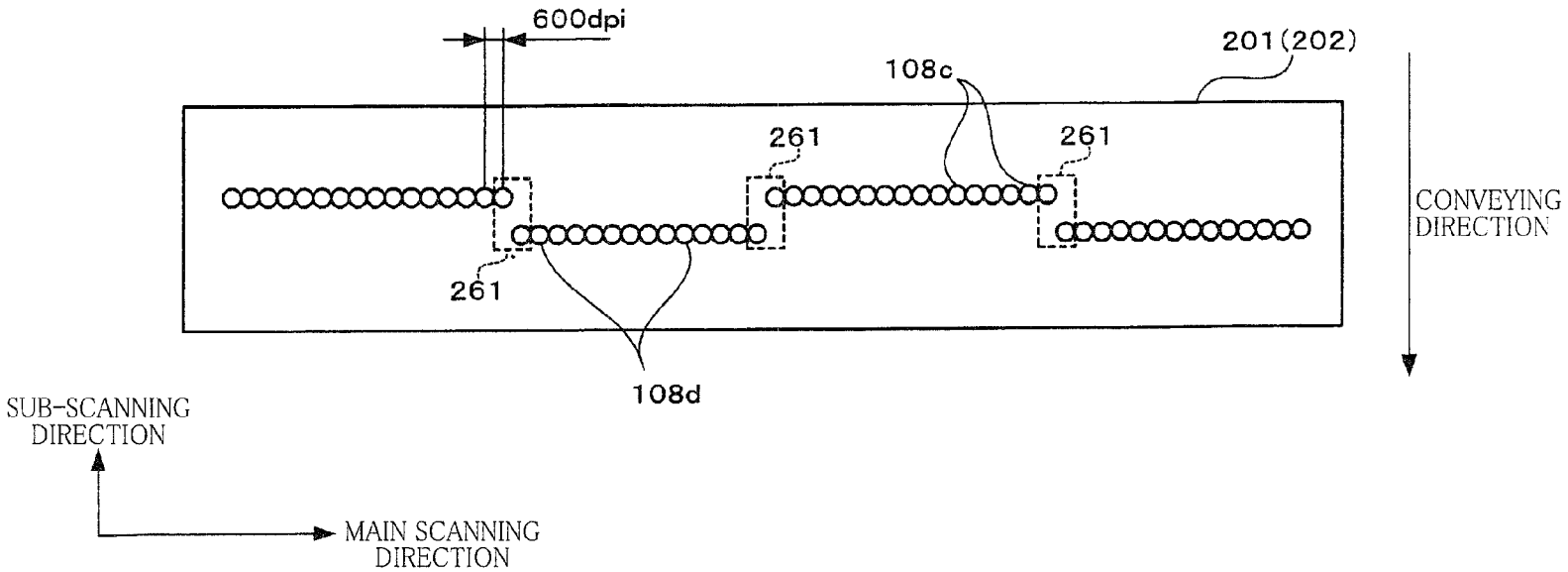
FIG. 7 is a plan view showing an ejection face of an ink-jet head of an ink-jet printer as a second embodiment of the present invention.

There will be next explained a second embodiment of the present invention. It is noted that, the same reference numerals as used in the first embodiment are used to designate corresponding elements and functioning sections, and an explanation thereof is dispensed with. As shown in FIG. 7, in an ejection face of a precoat head 202 of an ink-jet printer 201, four ejection-opening groups each constituted by a plurality of the ejection openings 108*c* or 108*d* arranged at pitches of 600 dpi in the main scanning direction are arranged in the main scanning direction in a staggered fashion. Each of ejection-opening groups located on an upstream side in the conveying direction (the sub-scanning direction) is constituted by the ejection openings 108*c*, and each of ejection-opening groups located on a downstream side in the conveying direction is constituted by the ejection openings 108*d*. Thus, when the image is recorded on the conveyed sheet P, the ink droplets ejected from the ejection openings 108*c* are landed on the sheet P, and then the ink droplets ejected from the ejection openings 108*d* are landed on the sheet P.

Figure 8:
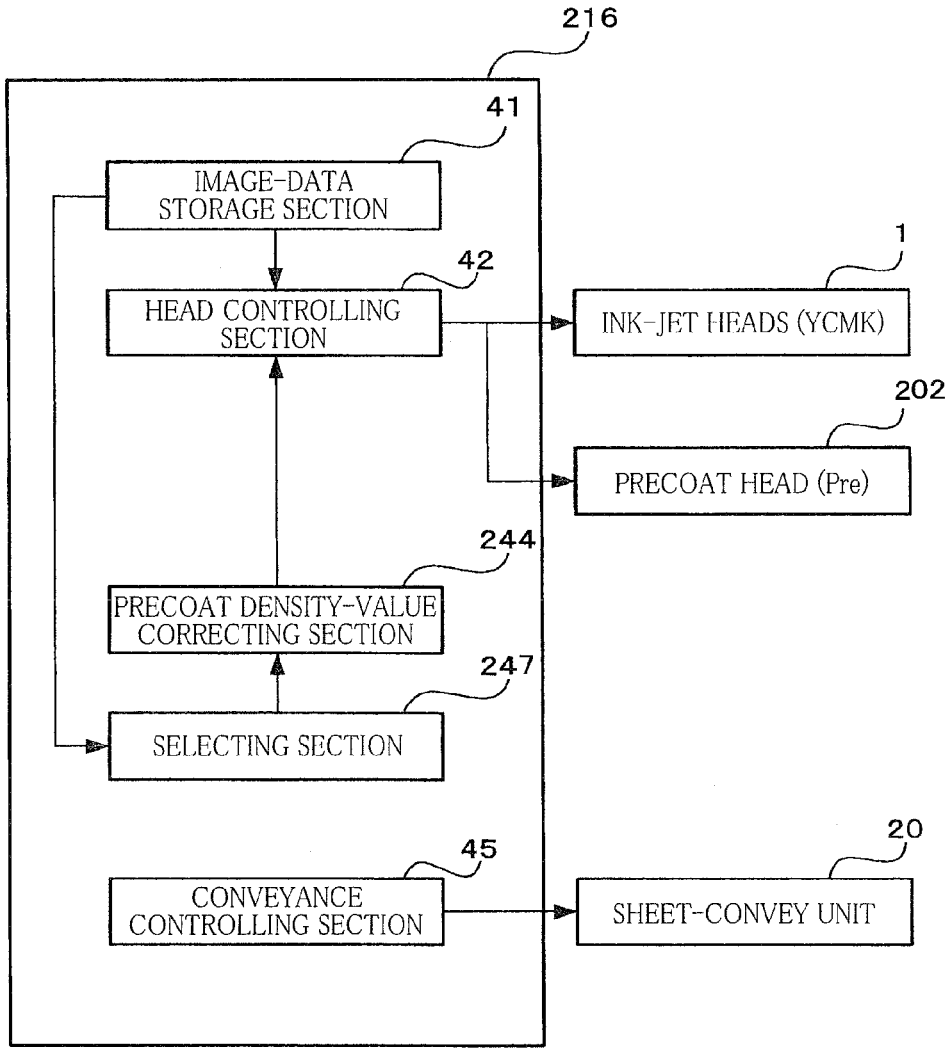
FIG. 8 is a block diagram of a controller of the second embodiment.
Figure 9:
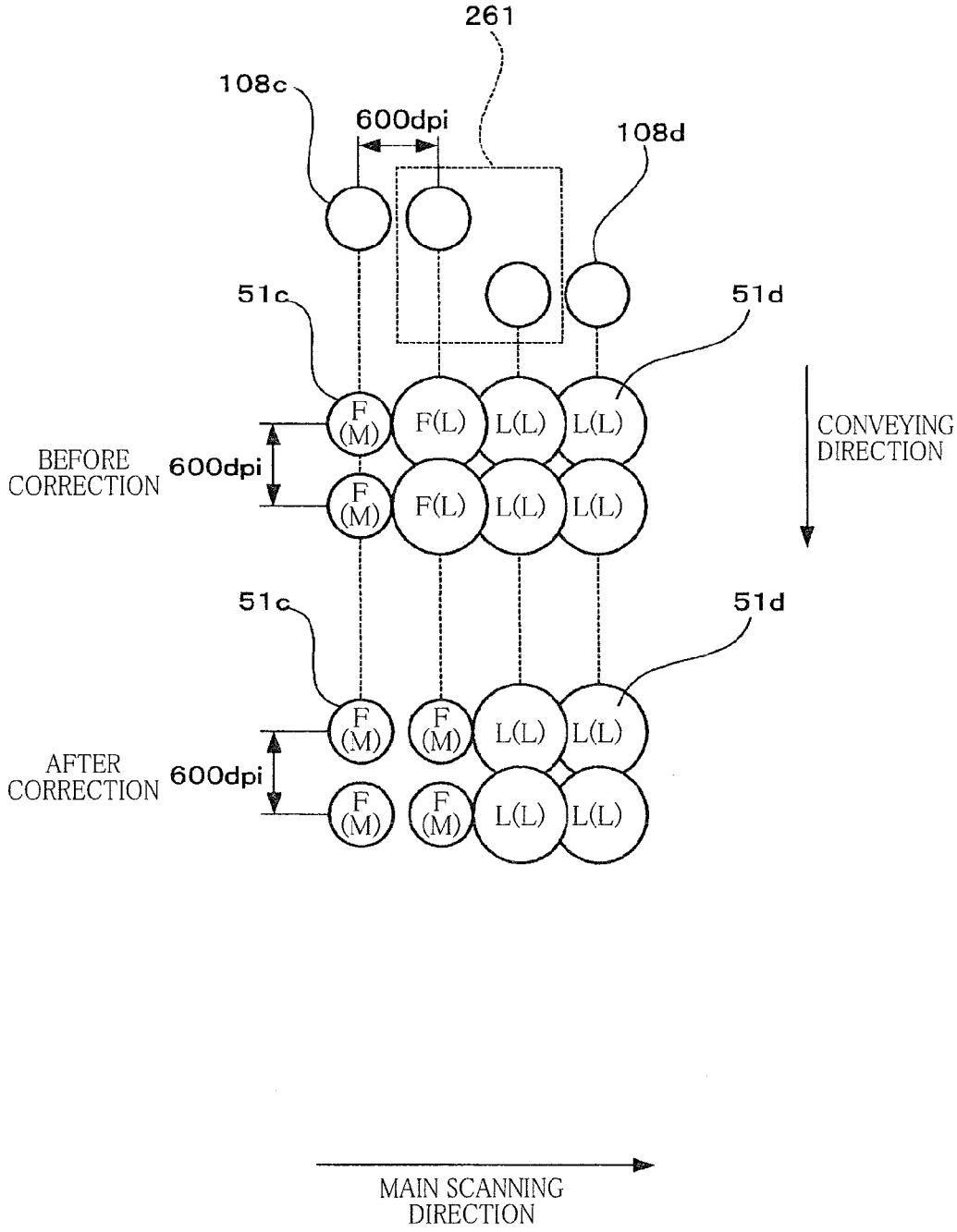
FIG. 9 is a view for explaining a selecting section shown in FIG. 8.

As shown in FIG. 8, a controller 216 includes the conveyance controlling section 45, the image-data storage section 41, the head controlling section 42, a selecting section 247, and a precoat density-value correcting section 244. As shown in FIG. 9, the selecting section 247 defines, as an ejection-opening pair 261, each two ejection openings 108*c*, 108*d* located at different positions in the conveying direction and adjacent to each other in the main scanning direction. The selecting section 247 selects a pixel corresponding to a smaller precoat-liquid density value among two pixels (adjacent unit areas) respectively adjacent in the main scanning direction to each pixel pair constituted by two pixels respectively corresponding to the ejection openings 108*c*, 108*d* of the defined ejection-opening pair 261. For example, in the case of FIG. 9, among the pixels on opposite sides of the pixel pair corresponding to the ejection-opening pair 261 in the main scanning direction, the precoat-liquid density value (the medium droplet) of the pixel corresponding to the ejection opening 108*c* and located on a left side of the pixel pair in FIG. 9 is smaller than the precoat-liquid density value (the large droplet) of the pixel corresponding to the ejection opening 108*d* and located on a right side of the pixel pair. Accordingly, the selecting section 247 selects the pixel corresponding to the smaller precoat-liquid density value.

The precoat density-value correcting section 244 reduces the precoat-liquid density value for the pixel adjacent to the pixel selected by the selecting section 247 among the two pixels of the pixel pair. As a result, in the example of FIG. 9, the amount of the precoat liquid ejected from the ejection opening 108*c* of the ejection-opening pair 261 is reduced.

In this second embodiment, the amount of the precoat liquid ejected from one of the ejection openings 108*c*, 108*d* in each pixel pair is reduced. Accordingly, it is possible to prevent that, before the precoat liquid ejected later from the ejection opening 108*d* of the ejection-opening pair 261 sufficiently permeates the sheet P, the precoat liquid ejected later is overlaid, on the sheet P, on the precoat liquid ejected first from the ejection opening 108*c* of the ejection-opening pair 261. As a result, both of the precoat liquids ejected respectively from the ejection openings 108*c*, 108*d* sufficiently permeate the sheet P and expand or spread over their respective desired areas. Thus, when the ejected ink has been landed on the precoat liquid, the ink forms a dot having a desired size. Accordingly, the streaks and the inconsistencies in density are less likely to occur on the recorded image, thereby preventing the lowering of the image quality.

Further, in this second embodiment, the amount of the precoat liquid ejected for the pixel adjacent to the pixel selected by the selecting section 247 among the two pixels of the pixel pair is reduced. Accordingly, the amount of the precoat liquid can be gradually changed in the conveying direction, making it possible to retain a continuity of the change of the precoat liquid. This prevents the lowering of the image quality due to the density inconsistencies.

Third Embodiment

Figure 10:
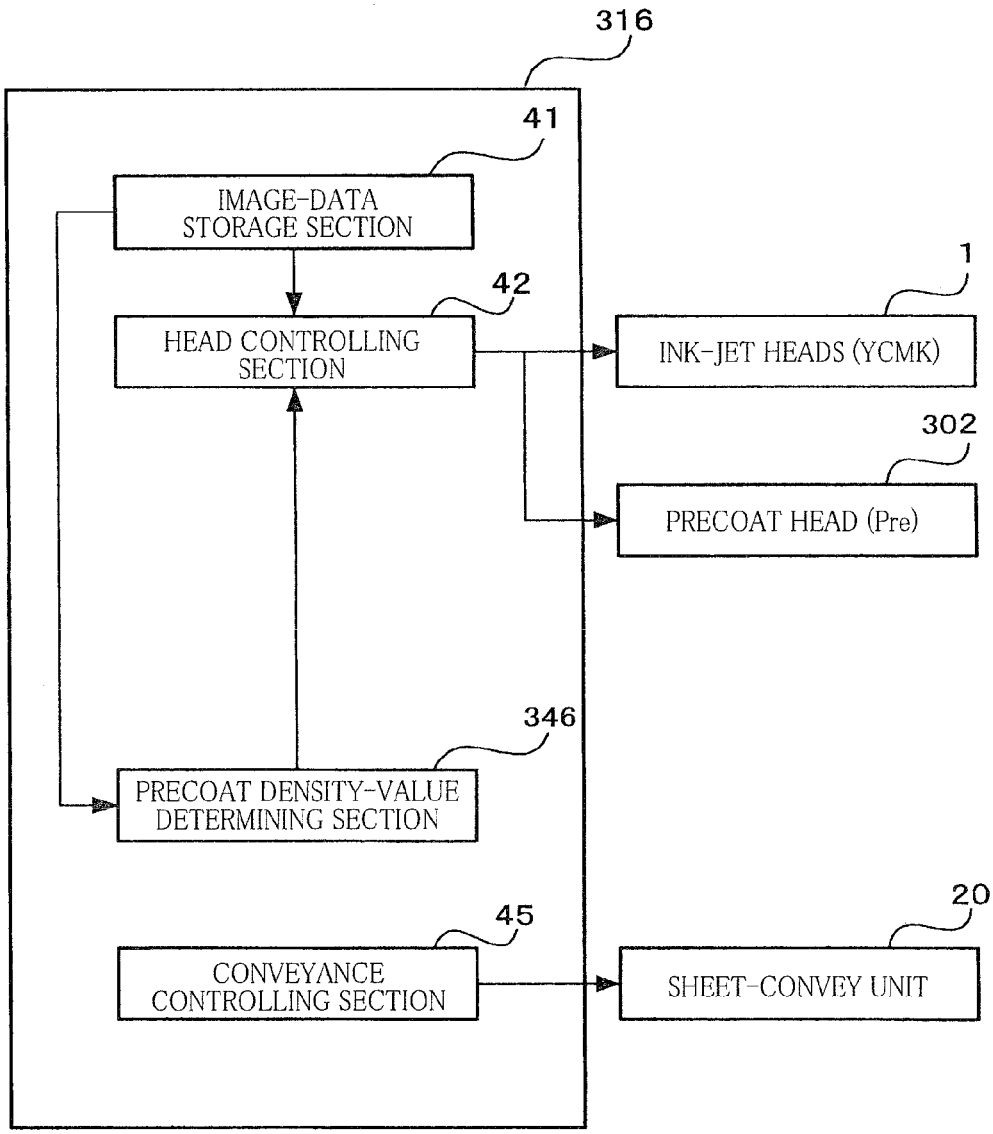
FIG. 10 is a block diagram of a controller of an ink jet printer as a third embodiment.

There will be next explained a third embodiment of the present invention. As shown in FIG. 10, a controller 316 of an ink-jet printer 301 of this third embodiment is different from the controller 16 of the first embodiment in that the controller 316 does not include the evaluation-value calculating section 43 and the precoat density-value correcting section 44 and includes a precoat density-value determining section 346. In this third embodiment, each density value is quantized into five values respectively corresponding to non-ejection, a small-sized droplet, a medium-sized droplet, a large-sized droplet and an extra-large sized droplet. These density values have the following relationship in size: a value corresponding to the non-ejection<a value corresponding to the small droplet<a value corresponding to the medium droplet<a value corresponding to the large droplet<a value corresponding to the extra-large droplet. It is noted that the larger the density value, a larger amount of the ink is ejected from the head.

Figure 11:
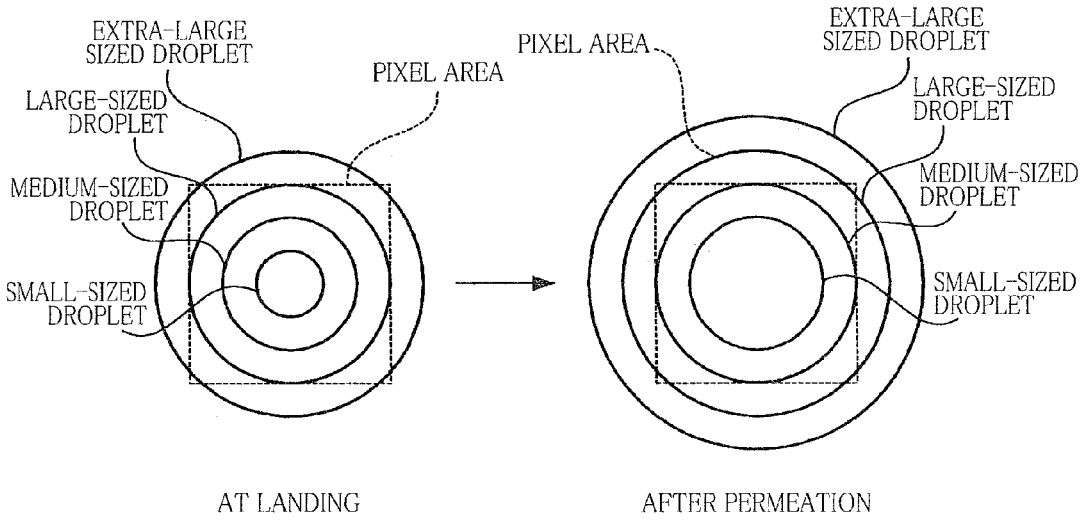
FIG. 11 is a view showing (a) a state of precoat liquid when precoat liquid droplets ejected from ejection openings of a head of the third embodiment have been landed on respective pixel areas of a sheet and (b) a state of the precoat liquid after the precoat liquid has sufficiently penetrated the pixel areas.

As shown in FIG. 11, each of the small droplet, the medium droplet, and the large droplet of the ink (or the precoat liquid) has an ink amount (an amount smaller than a second predetermined amount) in which, at a time when the ink has been landed on a pixel area of the sheet P which corresponds to a pixel of the image, the ink does not reach other pixel areas adjacent to the pixel area. The extra-large droplet of the ink has an ink amount (an amount larger than the second predetermined amount) larger than the ink amount in which, at a time when the ink has been landed on a pixel area, the ink does not reach other pixel areas adjacent to the pixel area. That is, when the extra-large droplet has been landed on the pixel area, the ink spreads to pixel area(s) next to the pixel area. Further, each of the small droplet and the medium droplet has an ink amount (an amount equal to or smaller than the first predetermined value or amount) in which, even where the ink has permeated the pixel area after its landing, the ink does not reach other pixel areas adjacent to the pixel area. Each of the large droplet and the extra-large droplet has an ink amount (an amount larger than the first predetermined amount) larger than the ink amount in which, even where the ink has permeated the pixel area after its landing, the ink does not reach other pixel areas adjacent to the pixel area. That is, when each of the large droplet and the extra-large droplet has been landed on the pixel area, the ink spreads to pixel area(s) next to the pixel area.

Returning to the explanation of FIG. 10, the precoat density-value determining section 346 determines the precoat-liquid density value corresponding to each pixel on the basis of the image data. Specifically, the precoat density-value determining section 346 extracts, from the image data, a largest one of density values of the inks of the four colors, namely, yellow, cyan, magenta, black, in each pixel (hereinafter, the largest one of the density values may be referred to as a "largest ink density value"). The precoat density-value determining section 346 then determines the precoat-liquid density value in the following manner for each pixel in each of even-numberth (in the conveying direction) pixel rows among the pixel rows. That is, where the largest ink density value for each pixel in each even-numberth pixel row is the density value corresponding to the extra-large droplet, the precoat density-value determining section 346 determines the precoat-liquid density value for the pixel as the density value of the large droplet. Where the largest ink density value for each pixel in each of even-numberth pixel rows is the density value corresponding to one of the small droplet, the medium droplet, and the large droplet, the precoat density-value determining section 346 determines the precoat-liquid density value as the largest ink density value. As a result, the precoat-liquid density value for each pixel in each even-numberth pixel row is proportional to the largest ink density value for the pixel in a range not exceeding the density value of the large droplet.

Figure 12:
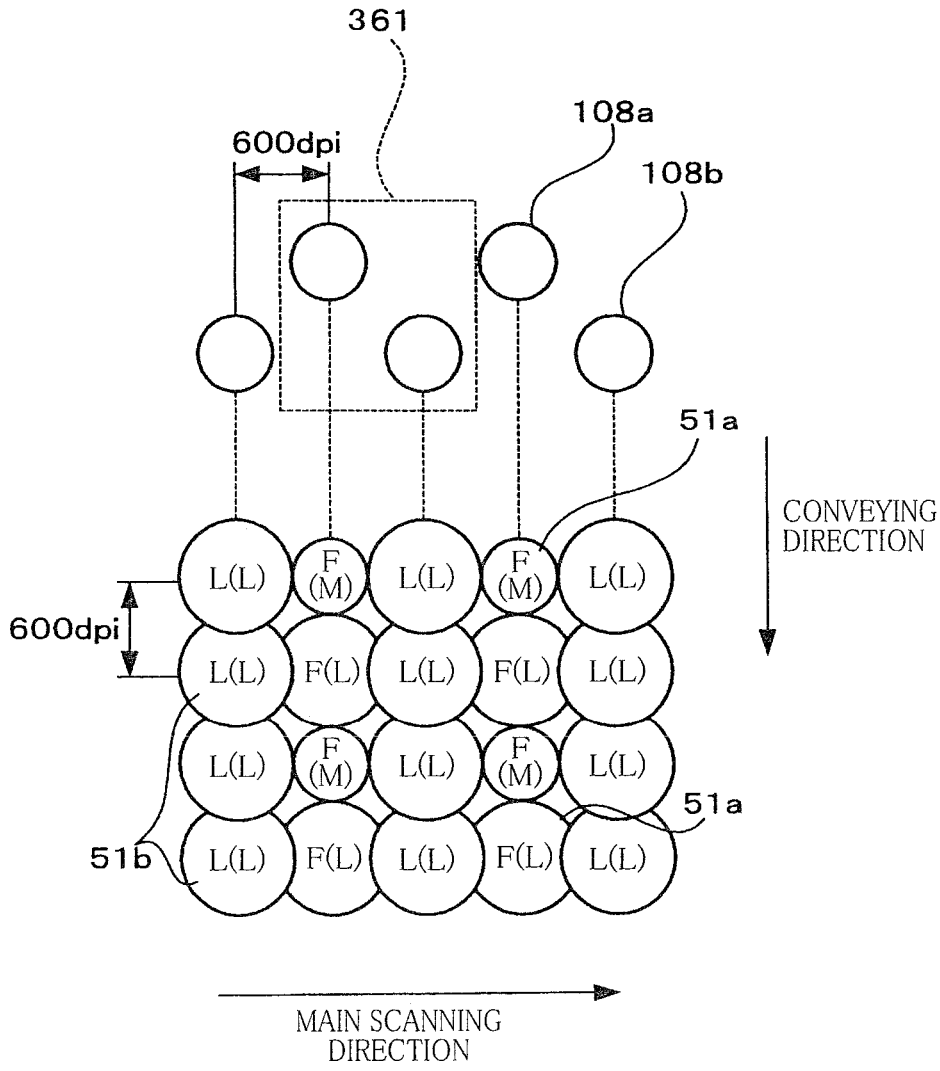
FIG. 12 is a view for explaining a precoat density-value determining section shown in FIG. 10.

Like the evaluation-value calculating section 43 of the first embodiment, the precoat density-value determining section 346 defines a plurality of pixel pairs each constituted by two pixels adjacent to each other in the main scanning direction in each of odd-numberth (in the conveying direction) pixel rows among the plurality of pixel rows. As described above, the ejection openings 108*a*, 108*b* are arranged alternately in the main scanning direction. Thus, as shown in FIG. 12, one pixel of each of the pixel pairs corresponds to the ejection opening 108*a*, and the other pixel of each pixel pair corresponds to the ejection opening 108*b*. The precoat density-value determining section 346 sets the ejection opening 108*a* and the ejection opening 108*b* respectively corresponding to the pixels of each pixel pair, as an ejection-opening pair 361 associated with the pixel pair.

Where a largest ink density value for a pixel corresponding to the precoat liquid to be ejected later in each pixel pair, i.e., a pixel corresponding to the precoat liquid to be ejected from the ejection opening 108*b*, is the density value corresponding to the extra-large droplet, the precoat density-value determining section 346 determines the precoat-liquid density value for the pixel corresponding to the precoat liquid to be ejected later, as the density value corresponding to the large droplet. Where the largest ink density value for the pixel corresponding to the precoat liquid to be ejected later is the density value of the small droplet, the medium droplet, or the large droplet, the precoat density-value determining section 346 determines the precoat-liquid density value for the pixel corresponding to the precoat liquid to be ejected later, as the largest ink density value. Further, where a largest ink density value for a pixel corresponding to the precoat liquid to be ejected first in each pixel pair, i.e., a pixel corresponding to the precoat liquid to be ejected from the ejection opening 108*a*, is the density value corresponding to the large droplet or the extra-large droplet, the precoat density-value determining section 346 determines the precoat-liquid density value for the pixel corresponding to the precoat liquid to be ejected first, as the density value corresponding to the medium droplet. Where the largest ink density value for the pixel corresponding to the precoat liquid to be ejected first is the density value of the small droplet or the medium droplet, the precoat density-value determining section 346 determines the precoat-liquid density value for the pixel corresponding to the precoat liquid to be ejected first, as the largest ink density value. As a result, the precoat-liquid density value for the pixel corresponding to the precoat liquid to be ejected first in each pixel pair in each odd-numberth pixel row is proportional to the largest ink density value corresponding to the pixel in a range not exceeding the density value corresponding to the medium droplet. In addition, the precoat-liquid density value for the pixel corresponding to the precoat liquid to be ejected later in each pixel pair in each odd-numberth pixel row is proportional to the largest ink density value corresponding to the pixel in a range not exceeding the density value corresponding to the large droplet.

In view of the above, the precoat-liquid density value for the pixel corresponding to the precoat liquid to be ejected first in each pixel pair is equal to or smaller than the density value corresponding to the medium droplet only in each odd-numberth pixel row. Accordingly, it is possible to prevent periodic density inconsistencies (e.g., streaks extending in the conveying direction) which may be caused by pixels having relatively small precoat-liquid density values and adjacent to each other in the conveying direction. It is noted that a density-value determining processing for the odd-numberth pixel rows and a density-value determining processing for the even-numberth pixel rows may be replaced with each other. Further, the density-value determining processing for the odd-numberth pixel rows may be performed for the even-numberth pixel rows in addition to the odd-numberth pixel rows. In this case, the periodic density inconsistencies may be caused on the image. However, even where the periodic density inconsistencies has been caused, image deterioration due to the periodic density inconsistencies is less than that due to the above-described density inconsistencies caused by the overlaying of the precoat liquid on the pixel pair. Further, in this case, the precoat-liquid density value for the pixel corresponding to the precoat liquid to be ejected first in the pixel pair may be a constant density value (e.g., the density value corresponding to the medium droplet) regardless of the density value of the ink corresponding to the pixel.

Returning to the explanation of FIG. 10, after the precoat density-value determining section 346 has determined the precoat-liquid density value for each pixel, the head controlling section 42 controls the precoat head 2 on the basis of the determined density value, such that the precoat liquid droplets are ejected from the ejection openings 108*a*, 108*b* at specific timings, and controls the ink-jet heads 1 on the basis of the image data, such that the ink droplets are ejected from the ejection openings 108*a*, 108*b* at specific timings.

Figure 13:
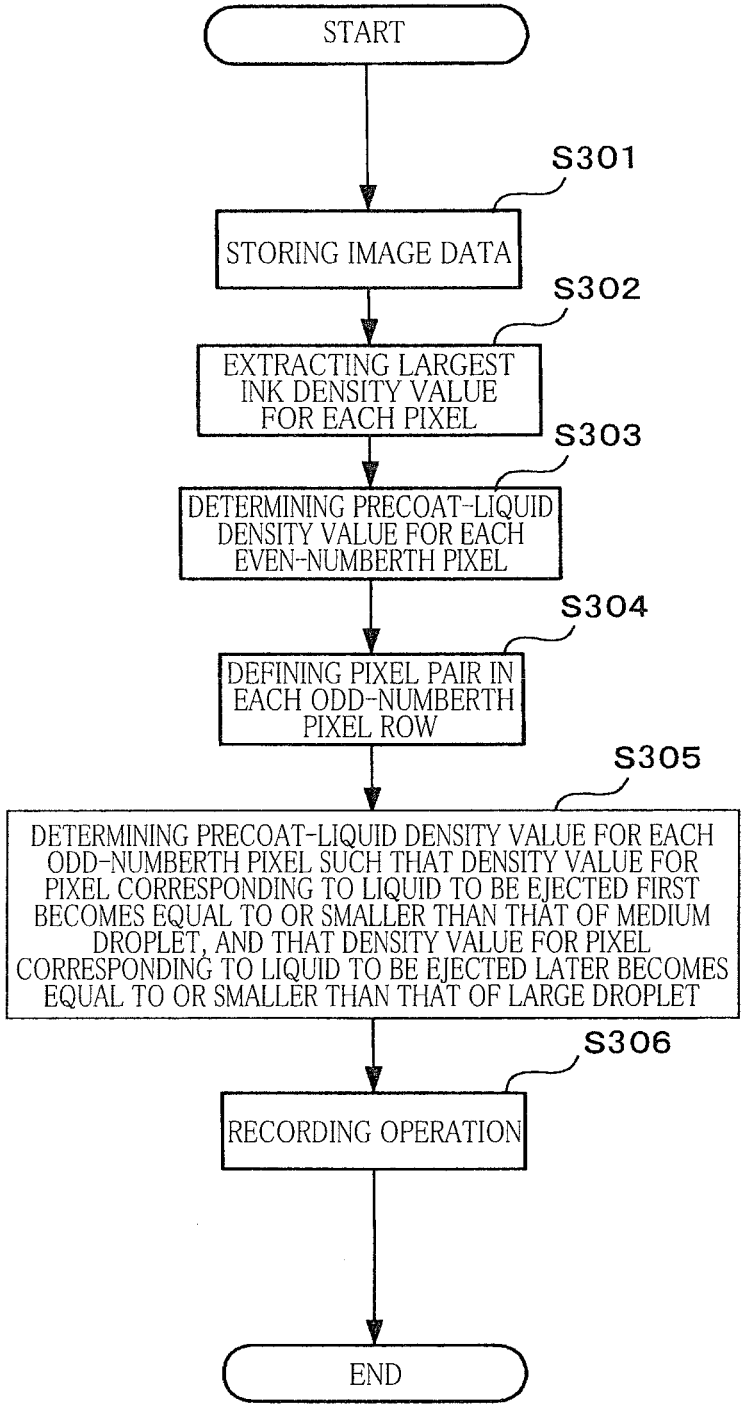
FIG. 13 is a flow-chart showing a recording operation of the ink-jet printer as the third embodiment.

There will be next explained the recording operation of the ink-jet printer 301. As shown in FIG. 13, initially in S301, when the ink-jet printer 301 has received the image data and the recording command from the external computer, the received image data is stored into the image-data storage section 41. Then in S302, the precoat density-value determining section 346 extracts, from the image data, the largest ink density value that is the largest one of the density values of the inks of the four colors, namely, yellow, cyan, magenta, black, in each pixel. Then in S303, the precoat density-value determining section 346 then determines the precoat-liquid density value for each pixel in each of even-numberth pixel rows in the following manner. That is, where the largest ink density value for each pixel in each of even-numberth pixel rows is the density value corresponding to the extra-large droplet, the precoat density-value determining section 346 determines the precoat-liquid density value for the pixel as the density value of the large droplet. Where the largest ink density value for each pixel in each of even-numberth pixel rows is the density value corresponding to the small droplet, the medium droplet, or the large droplet, the precoat density-value determining section 346 determines the precoat-liquid density value as the largest ink density value.

In S304, the precoat density-value determining section 346 defines a plurality of pixel pairs in each odd-numberth pixel row. Then in S305, the precoat density-value determining section 346 determines the precoat-liquid density value in the following manner for each pixel in each odd-numberth pixel row. Where a largest ink density value for a pixel corresponding to the precoat liquid to be ejected later in each pixel pair is the density value corresponding to the extra-large droplet, the precoat density-value determining section 346 determines the precoat-liquid density value for the pixel corresponding to the precoat liquid to be ejected later, as the density value corresponding to the large droplet. Where the largest ink density value for the pixel corresponding to the precoat liquid to be ejected later is the density value of the small droplet, the medium droplet, or the large droplet, the precoat density-value determining section 346 determines the precoat-liquid density value for the pixel corresponding to the precoat liquid to be ejected later, as the largest ink density value. Further, where a largest ink density value for a pixel corresponding to the precoat liquid to be ejected first in each pixel pair is the density value corresponding to the large droplet or the extra-large droplet, the precoat density-value determining section 346 determines the precoat-liquid density value for the pixel corresponding to the precoat liquid to be ejected first, as the density value corresponding to the medium droplet. Where the largest ink density value for the pixel corresponding to the precoat liquid to be ejected first is the density value corresponding to the small droplet or the medium droplet, the precoat density-value determining section 346 determines the precoat-liquid density value for the pixel corresponding to the precoat liquid to be ejected first, as the largest ink density value.

In S306, the head controlling section 42 controls the precoat head 2 and each ink-jet head 1 to respectively eject the precoat liquid and the ink droplets onto the sheet P on the basis of the image data corrected by the precoat density-value determining section 346, and the recording operation is finished (the processing in the flow-chart in FIG. 13 is finished).

As described above, in this printer 301, the precoat liquid droplet equal to or smaller than the medium droplet is ejected first onto a pixel area corresponding to one pixel of the pixel pair in each odd-numberth pixel row. Thus, the ejected precoat liquid droplet does not reach other pixel areas adjacent to the pixel area at and after the landing of the precoat liquid droplet. Further, the precoat liquid droplet equal to or smaller than the large droplet is ejected onto the other pixel area corresponding to the other pixel of the pixel pair. Thus, the ejected precoat liquid droplet does not reach other pixel areas adjacent to the other pixel area when the precoat liquid droplet has been landed on the pixel area. Accordingly, it is possible to prevent that the precoat liquid ejected later from the ejection opening 108*b* is overlaid on the precoat liquid ejected earlier from the ejection opening 108*a* on the sheet P. As a result, both of the precoat liquids ejected respectively from the ejection openings 108*a*, 108*b* sufficiently permeate the sheet P and expand or spread over their respective desired areas, reducing an area of the precoat liquid remaining in the liquid-layer state. Thus, when the ejected ink droplet has been landed on the precoat liquid, the ink forms a dot having desired size and density. Accordingly, the streaks and the inconsistencies in density are less likely to occur on the recorded image, thereby preventing the lowering of the image quality.

Further, in each odd-numberth pixel row, an amount of the precoat liquid droplet ejected from the ejection opening 108*a* of the precoat head 2 is determined as an amount according to the ink amount in a range not exceeding the medium droplet, thereby reducing a consumption of the precoat liquid.

In addition, the ejection openings 108*a*, 108*b* adjacent to each other in the main scanning direction in each pair are formed at different positions in the sub-scanning direction. Accordingly, when the ejection openings are formed, a distance between each pair of the ejection openings in the main scanning direction can be reduced to increase a resolution.

Modification

Figure 14:
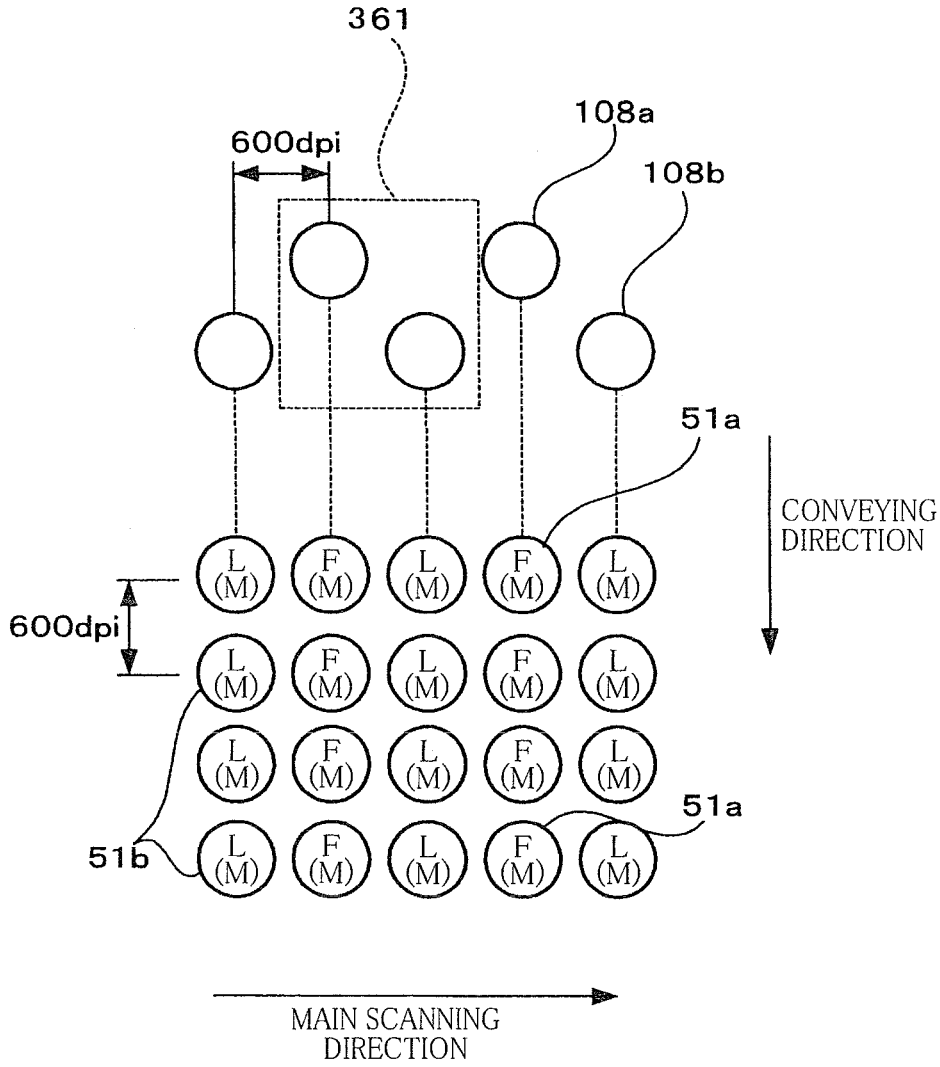
FIG. 14 is a view for explaining a modification of the third embodiment.

In the above-mentioned third embodiment, the precoat density-value determining section 346 determines the precoat-liquid density value only for each odd-numberth pixel row in the following manner. That is, where the largest ink density value for the pixel corresponding to the precoat liquid to be ejected first in each pixel pair is the density value corresponding to the large droplet or the extra-large droplet, the precoat density-value determining section 346 determines the precoat-liquid density value for the pixel corresponding to the precoat liquid to be ejected first, as the density value corresponding to the medium droplet. Where the largest ink density value for the pixel corresponding to the precoat liquid to be ejected first is the density value of the small droplet or the medium droplet, the precoat density-value determining section 346 determines the precoat-liquid density value for the pixel corresponding to the precoat liquid to be ejected first, as the largest ink density value. However, as shown in FIG. 14, the precoat density-value determining section 346 may determine a precoat-liquid density value for each pixel whose largest ink density value is not zero, as the density value corresponding to the medium droplet.

In this modification, each precoat liquid droplet ejected from the ejection openings 108*a*, 108*b* onto a corresponding pixel area does not reach other pixel areas adjacent to the pixel area at and after the landing of the precoat liquid droplet. Thus, it is possible to reliably prevent that the precoat liquid ejected later from the ejection opening 108*b* is overlaid on the precoat liquid ejected earlier from the ejection opening 108*a* on the sheet P. Further, since the precoat-liquid density values for the respective pixels are constant, it is possible to reduce a computing processing for determining the density values. It is noted that the precoat density-value determining section 346 may determine the precoat-liquid density value for each pixel whose largest ink density value is not zero, as the density value corresponding to the small droplet.

Fourth Embodiment

An ink-jet printer 401 as this fourth embodiment includes the controller 16 as in the first embodiment. In the first embodiment, where the amount of the precoat liquid to be ejected first in each pixel pair is equal to or larger than the predetermined amount, the evaluation-value calculating section 43 calculates the area in which the precoat dots 51*a*, 51*b* respectively formed for the pixels of the pixel pair are overlaid on each other, as the evaluation value of the pixel pair. However, in this fourth embodiment, the evaluation-value calculating section 43 calculates the evaluation value in the following manner. That is, the evaluation-value calculating section 43 extracts, from the image data, the largest ink density value for each pixel and temporarily determines the extracted largest ink density value as the precoat-liquid density value for the pixel. Then, where the temporarily determined precoat-liquid density value for a pixel corresponding to the precoat liquid droplet to be ejected first in the defined pixel pair is equal to or larger than the density value corresponding to the large droplet, the evaluation-value calculating section 43 calculates the area in which the precoat dots 51*a*, 51*b* respectively formed for the pixels of the pixel pair are overlaid on each other, as the evaluation value of the pixel pair. Specifically, by referring to the table in which the precoat-liquid density value and the elapsed time are associated with each of areas of the respective precoat dots, the evaluation-value calculating section 43 obtains respective areas of the precoat dots 51*a*, 51*b* on the basis of the temporarily determined precoat-liquid density value for each pixel of the pixel pair and the elapsed time, and calculates, as the evaluation value, the area in which the precoat dots 51*a*, 51*b* are overlaid on each other, on the basis of the areas and positions of the respective precoat dots 51*a*, 51*b*. The precoat density-value correcting section 44 then performs the correction processing in the same manner as in the first embodiment for the density value of the precoat liquid temporarily determined by the evaluation-value calculating section 43.

In this fourth embodiment, the same advantages obtained in the first embodiment can be obtained. That is, since the above-described correction processing is performed only for the odd-numberth (in the conveying direction) pixel rows, pixels respectively corresponding to the reduced precoat-liquid density values are never located adjacent to each other in the conveying direction. Further, with attention to two ejection-opening pairs 61 sharing the same ejection openings 108*a*, 108*b* and contiguous or adjacent to each other in the main scanning direction, pixels each corresponding to the precoat liquid having a reduced amount are not adjacent to each other in the main scanning direction among the plurality of pixels corresponding to each of the ejection openings 108*a*, 108*b*. As a result, it is possible to prevent that the areas lacking the precoat liquid are contiguous to each other in the conveying direction.

Further, in this printer 401, the precoat liquid droplet ejected first onto one pixel area from the ejection opening 108*a* of the ejection-opening pair 61 does not reach other pixel areas adjacent to the one pixel area at and after the landing of the precoat liquid droplet. In addition, the precoat liquid droplet ejected later onto another pixel area from the ejection opening 108*b* does not reach other pixel areas adjacent to said another pixel area at the landing. Accordingly, it is possible to prevent that the precoat liquid ejected later from the ejection opening 108*b* is overlaid on the precoat liquid ejected earlier from the ejection opening 108*a* on the sheet P.

Fifth Embodiment

Figure 15:
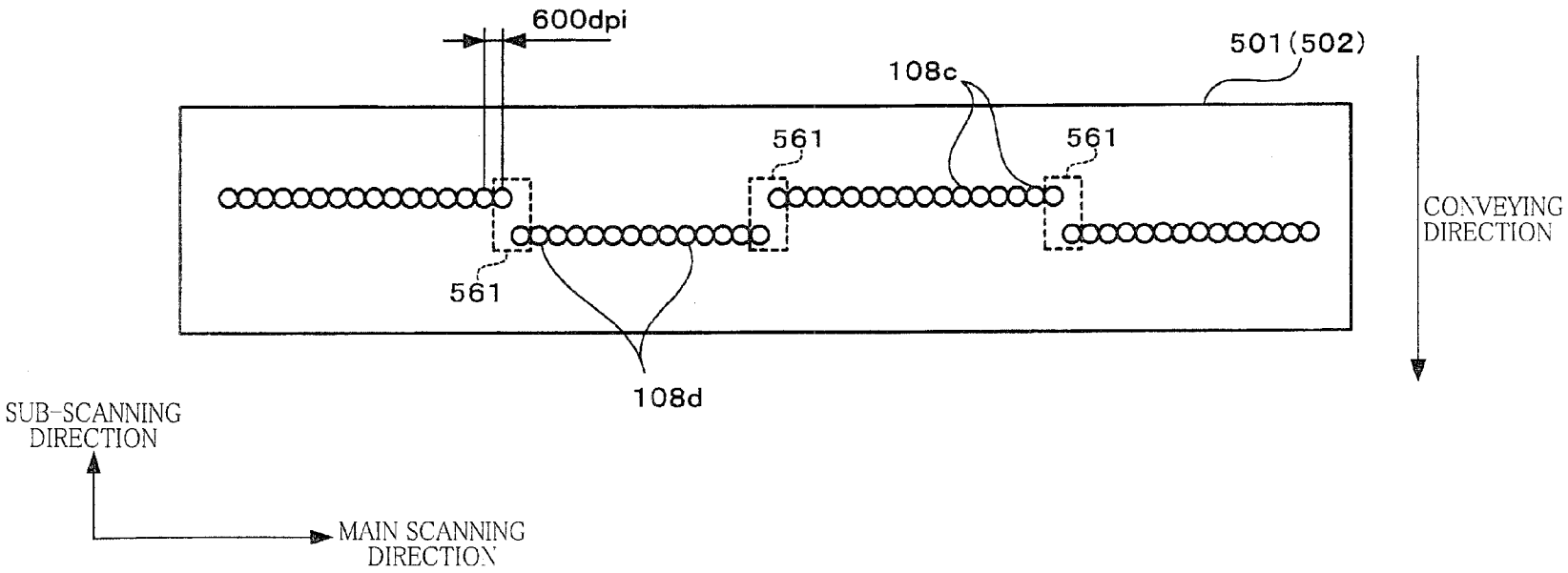
FIG. 15 is a plan view showing an ejection face of an ink-jet head of an ink-jet printer as a fifth embodiment.

There will be next explained a fifth embodiment of the invention. A controller 516 of an ink-jet printer 501 as the present embodiment is different from the above-described controller 16 in the first embodiment in that the controller 516 does not include the evaluation-value calculating section 43 and the precoat density-value correcting section 44 and includes a precoat density-value determining section 546 and a selecting section 547. As shown in FIG. 15, in an ejection face of a precoat head 502, four ejection-opening groups each constituted by a plurality of the ejection openings 108*c* or 108*d* arranged at pitches of 600 dpi in the main scanning direction are arranged in the main scanning direction in a staggered fashion. Each of ejection-opening groups located on an upstream side in the conveying direction (the sub-scanning direction) is constituted by the ejection openings 108*c*, and each of ejection-opening groups located on a downstream side in the conveying direction is constituted by the ejection openings 108*d*. Thus, when the image is recorded on the conveyed sheet P, the ink droplets ejected from the ejection openings 108*c* are landed on the sheet P, and then the ink droplets ejected from the ejection openings 108*d* are landed on the sheet P.

Figure 16:
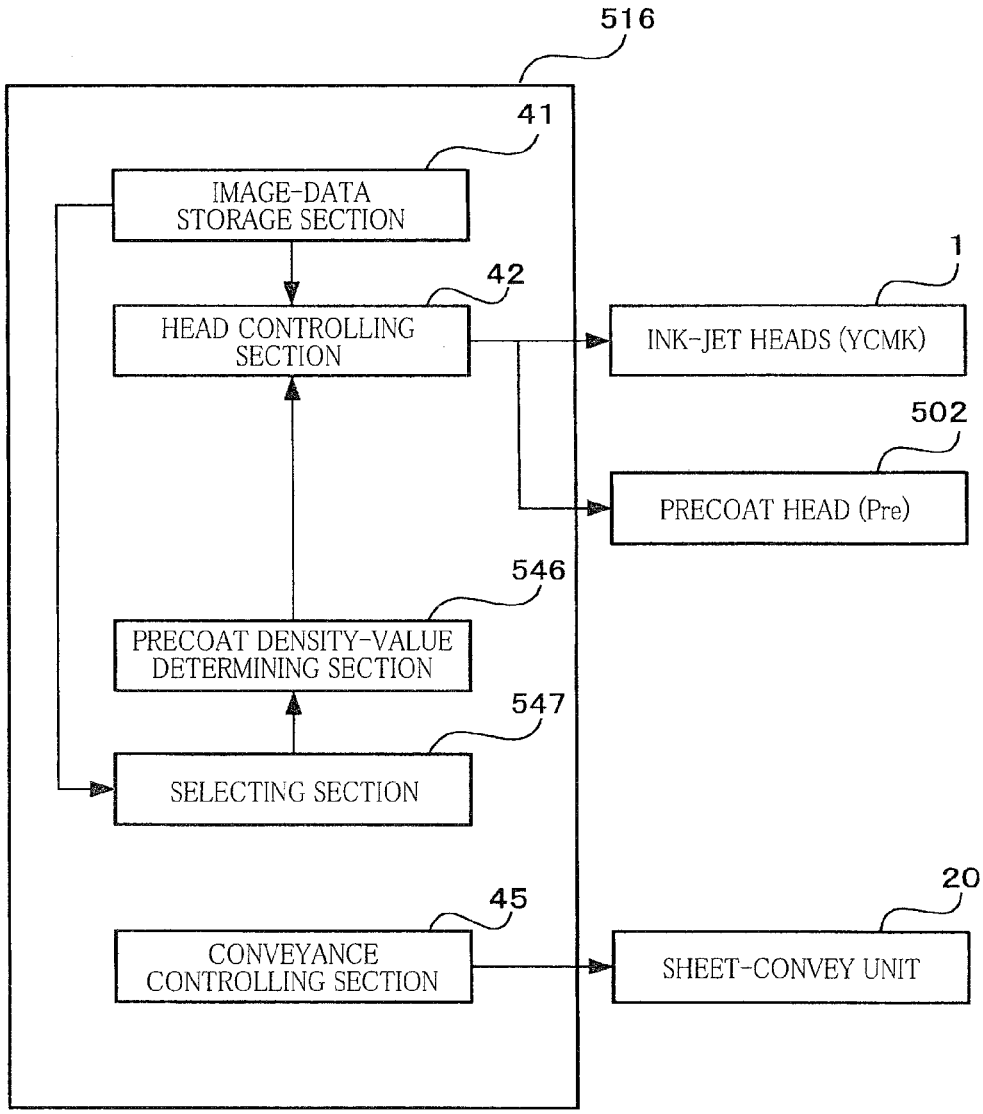
FIG. 16 is a view for explaining a function of a precoat density-value determining section shown in FIG. 15.

As shown in FIG. 16, the precoat density-value determining section 546 extracts, from the image data, the largest ink density value for each pixel. Further, the precoat density-value determining section 546 defines, as an ejection-opening pair 561, each two ejection openings 108*c*, 108*d* located at different positions in the conveying direction and adjacent to each other in the main scanning direction. The precoat density-value determining section 546 then determines the precoat-liquid density value corresponding to each pixel in the pixel pair corresponding to the ejection openings 108*c*, 108*d* of the defined ejection-opening pair 561 in the following manner. That is, where a largest ink density value for a pixel corresponding to the precoat liquid to be ejected later in the pixel pair, i.e., a pixel corresponding to the precoat liquid to be ejected from the ejection opening 108*d*, is the density value corresponding to the extra-large droplet, the precoat density-value determining section 546 determines the precoat-liquid density value for the pixel corresponding to the precoat liquid to be ejected later, as the density value corresponding to the large droplet. Where the largest ink density value for the pixel corresponding to the precoat liquid to be ejected later is the density value of the small droplet, the medium droplet, or the large droplet, the precoat density-value determining section 546 determines the precoat-liquid density value for the pixel corresponding to the precoat liquid to be ejected later, as the largest ink density value. Further, where a largest ink density value for a pixel corresponding to the precoat liquid to be ejected first in the pixel pair, i.e., a pixel corresponding to the precoat liquid to be ejected from the ejection opening 108*c*, is the density value corresponding to the large droplet or the extra-large droplet, the precoat density-value determining section 546 determines the precoat-liquid density value for the pixel corresponding to the precoat liquid to be ejected first, as the density value corresponding to the medium droplet. Where the largest ink density value for the pixel corresponding to the precoat liquid to be ejected first is the density value of the small droplet or the medium droplet, the precoat density-value determining section 546 determines the precoat-liquid density value for the pixel corresponding to the precoat liquid to be ejected first, as the largest ink density value.

Further, where the extracted density value for each pixel not belonging to the pixel pair is the density value corresponding to the extra-large droplet, the precoat density-value determining section 546 determines the precoat-liquid density value for the pixel not belonging to the pixel pair, as the density value corresponding to the large droplet. Where the extracted density value for each pixel not belonging to the pixel pair is the density value corresponding to the droplet other than the extra-large droplet, the precoat density-value determining section 546 determines the precoat-liquid density value for the pixel not belonging to the pixel pair, as the extracted density value.

In the printer 501 of this fifth embodiment, the precoat liquid droplet ejected first onto one pixel area from the ejection openings 108*c* of the ejection-opening pair 561 does not reach other pixel areas adjacent to the one pixel area at and after the landing of the precoat liquid droplet of the precoat liquid droplet. In addition, the precoat liquid droplet ejected later onto another pixel area from the ejection opening 108*d* does not reach other pixel areas adjacent to said another pixel area at the landing of the precoat liquid droplet. Accordingly, it is possible to prevent that the precoat liquid ejected later from the ejection opening 108*d* is overlaid on the precoat liquid ejected earlier from the ejection opening 108*c* on the sheet P.

Further, the precoat head 502 has a simple liquid-channel structure in which the plurality of ejection-opening groups are combined with one another, thereby facilitating producing the precoat head 502.

Modification

In the printer 501 of the fifth embodiment, the precoat density-value determining section 546 determines the precoat-liquid density value in the following manner only for the pixel corresponding to the precoat liquid to be ejected first in the pixel pair. That is, where the largest ink density value for the pixel corresponding to the precoat liquid to be ejected first in the pixel pair is the density value corresponding to the large droplet or the extra-large droplet, the precoat density-value determining section 546 determines the precoat-liquid density value for the pixel corresponding to the precoat liquid to be ejected first, as the density value corresponding to the medium droplet. Where the largest ink density value for the pixel corresponding to the precoat liquid to be ejected first is the density value of the small droplet or the medium droplet, the precoat density-value determining section 546 determines the precoat-liquid density value for the pixel corresponding to the precoat liquid to be ejected first, as the largest ink density value. However, the precoat density-value determining section 546 may determine the precoat-liquid density value in the same manner also for the pixel corresponding to the precoat liquid to be ejected later in the pixel pair. Further, the precoat density-value determining section 546 may determine the precoat-liquid density value in the same manner also for each pixel other than the pixel pair. Further, the precoat density-value determining section 546 may determine the precoat-liquid density value for each pixel whose largest ink density value is not zero, as the density value corresponding to the medium droplet.

Where the printer 501 is configured in this manner, the precoat liquid droplet ejected onto one pixel area from each ejection opening 108*c*, 108*d* does not reach other pixel areas adjacent to the one pixel area at and after the landing of the precoat liquid droplet. Accordingly, it is possible to reliably prevent that the precoat liquid ejected later from the ejection opening 108*d* is overlaid on the precoat liquid ejected earlier from the ejection opening 108*c* on the sheet P. Further, since the precoat-liquid density values for the respective pixels are constant, it is possible to reduce the computing processing for determining the density values.

While the embodiments of the present invention have been described above, it is to be understood that the invention is not limited to the details of the illustrated embodiments, but may be embodied with various changes and modifications, which may occur to those skilled in the art, without departing from the spirit and scope of the invention. In the above-described first embodiment, the amount of the precoat liquid ejected first from the ejection opening 108*a* is reduced in each pixel pair. However, the amount of the precoat liquid ejected later from the ejection opening 108*b* may be reduced, or both of the amounts of the precoat liquid ejected from the ejection openings 108*a*, 108*b* may be reduced. Further, these configurations may be mixed.

Further, in the above-described first embodiment, where the evaluation value calculated by the evaluation-value calculating section 43 is equal to or larger than the predetermined value, the precoat density-value correcting section 44 reduces the precoat-liquid density value for the pixel corresponding to the ejection opening 108*b* such that the evaluation value becomes smaller than the predetermined value, but the present invention is not limited to this configuration. For example, this printer may be configured such that the precoat density-value correcting section, without calculating the evaluation value, reduces a precoat-liquid density value for a pixel for one of the ejection openings 108*a*, 108*b* in each pixel pair such that an amount of the precoat liquid to be ejected from the one of the ejection openings 108*a*, 108*b* becomes equal to or smaller than a predetermined density value.

Further, in the above-described first embodiment, the correction processing is performed such that the pixels both having respective reduced density values are not adjacent to each other in the conveying direction and the main scanning direction, but the present invention is not limited to this configuration. For example, the correction processing may be performed such that the pixels both having respective reduced density values are at least partly adjacent to each other in at least one of the conveying direction and the main scanning direction.

Further, the printer may be configured such that one ink-jet head ejects ink droplets of a plurality of colors and the precoat liquid droplets.

Further, in the above-described third, fourth, and fifth embodiments, the precoat-liquid density value is determined on the basis of the largest ink density value of each of the inks of the four colors (yellow, cyan, magenta, and black) but may be determined on the basis of a total value of ink density values of the respective inks of the four colors (yellow, cyan, magenta, and black). Where the printer is configured in this manner, a balance between an entire ink amount and the precoat liquid can be retained, making it possible to consider color saturation of entire pixels.

Further, in the above-described third, fourth, and fifth embodiments, each ink-jet head is configured to eject the ink droplet of the medium droplet or the small droplet having an ink amount in which even where the ink droplet ejected first for a pixel of a pixel pair has sufficiently permeated a corresponding pixel area after its landing, the ink droplet does not reach other pixel areas adjacent to the pixel area, but the present invention is not limited to this configuration. For example, the printer may be configured such that, when the ink droplet ejected later in the pixel pair has been landed on a pixel area on which the ink droplet ejected first had been landed, the head ejects an ink droplet having such an ink amount that the ink droplet does not reach other pixel areas adjacent to the pixel area (for example, the medium droplet).

The present invention is also applicable to a liquid ejection apparatus configured to eject liquid other than the ink. Further, the application of the present invention is not limited to the printer, and the present invention is applicable to a facsimile machine, copying machine, and the like. Further, the head controlling section may control each head to eject the precoat liquid or the ink not by driving an actuator unit of the precoat head or an actuator unit of each ink-jet head but by driving a heating element of the precoat head or each ink-jet head. Further, an action of the precoat liquid on the ink includes coagulation or precipitation of the components of the ink such as the pigment and dye by a chemical reaction caused by mixing of the ink and the precoat liquid. Further, the action of the precoat liquid on the ink includes coagulation or precipitation of the components of the ink such as the pigment and dye without a chemical reaction. Further, as described above, the precoat liquid for coagulating the pigment color components is generally used for the pigment ink, and the precoat liquid for precipitating the dye color components is generally used for the dye ink, but the precoat liquid may include both properties of the coagulation and the precipitation. Further, the present invention is applicable to an application soft or a driver soft installed into a computer.

What is claimed is:

1. A liquid ejection apparatus, comprising:

a conveying mechanism configured to convey a recording medium in a predetermined conveying direction;

a storage device configured to store image data;

a first-liquid ejection head having a plurality of first ejection openings formed therein for ejecting a first liquid to form an image on the recording medium;

a second-liquid ejection head having a plurality of second ejection openings formed therein for ejecting a second liquid having a property of coagulating or precipitating components of the first liquid, the second-liquid ejection head being disposed upstream of the first-liquid ejection head in the conveying direction, an amount of the second liquid to be ejected from each of the plurality of second ejections opening being determined based on the image data; and a controller configured to control the first-liquid ejection head and the second-liquid ejection head, wherein the recording medium is separated into a plurality of unit areas along the conveying direction and a perpendicular main scanning direction that is perpendicular to the conveying direction, the plurality of unit areas respectively corresponding to a plurality of pixels defined by a resolution of the image, and the controller being further configured to judge whether the determined amount of the second liquid to be ejected from an earlier-ejection opening of a pair of second ejection openings of the plurality of second ejection openings is equal to or greater than a first predetermined value, the pair of second ejection openings being constituted by the earlier-ejection opening and a later-ejection opening which are arranged side by side in the main scanning direction and arranged at different positions in the conveying direction, the second-liquid ejection head being configured to eject the second liquid from the earlier-ejection opening onto one of a pair of unit areas of the plurality of unit areas at an earlier timing than from the later-ejection opening onto the other of the pair of unit areas, the pair of unit areas being located at the same position in the conveying direction and arranged side by side in the main scanning direction;

determine an amount of the second liquid to be ejected from the earlier-ejection opening for which the controller has judged that the determined amount of the second liquid is equal to or greater than the first predetermined value, to an amount smaller than the first predetermined value; and determine an amount of the second liquid to be ejected from the later-ejection opening, to an amount that is determined based on the image data for the other of the pair of unit area.

2. A liquid ejection apparatus, comprising:

a conveying mechanism configured to convey a recording medium in a predetermined conveying direction;

a storage device configured to store image data;

a first-liquid ejection head having a plurality of first ejection openings formed therein for ejecting a first liquid to form an image on the recording medium;

a second-liquid ejection head having a plurality of second ejection openings formed therein for ejecting a second liquid having a property of coagulating or precipitating components of the first liquid, the second-liquid ejection head being disposed upstream of the first-liquid ejection head in the conveying direction, an amount of second liquid to be ejected from each of the plurality of second ejection openings being determined based on the image data; and a controller configured to control the first-liquid ejection head and the second-liquid ejection head, wherein the recording medium is separated into a plurality of unit areas along the conveying direction and a main scanning direction that is perpendicular to the conveying direction, the plurality of unit areas respectively corresponding to a plurality of pixels defined by a resolution of the image, and the controller being further configured to:

judge whether the determined amount of the second liquid to be ejected from an earlier-ejection opening of a pair of second ejection openings of the plurality of second ejection openings is equal to or greater than a first predetermined value;

judge whether the determined amount of the second liquid to be ejected from a later-ejection opening of the pair of second ejection openings is equal to or greater than a second predetermined value, the earlier-ejection opening and the later-ejection opening being arranged side by side in the main scanning direction and arranged at different positions in the conveying direction, the second-liquid ejection head being configured to eject the second liquid from the earlier-ejection opening onto one of a pair of unit areas of the plurality of unit areas at an earlier timing than from the later-ejection opening onto the other of the pair of unit areas, the pair of unit areas being located at the same position in the conveying direction and arranged side by side in the main scanning direction, determine an amount of the second liquid to be ejected from the earlier-ejection opening for which the controller has judged that the determined amount of the second liquid is equal to or greater than the first predetermined value, to an amount smaller than the first predetermined value; and determine an amount of the second liquid to be ejected from the later-ejection opening for which the controller has judged that the determined amount of the second liquid is equal to or greater than the second predetermined value, to an amount smaller than the second predetermined value, wherein the first predetermined value is an amount of the second liquid in which, at a time when or after the second liquid has been landed on one of the unit areas, the second liquid does not reach another unit area next to the unit area on which the second liquid has been landed, wherein the second predetermined value that is an amount of the second liquid in which, at a time when the second liquid has been landed on one of the unit areas, the second liquid does not reach another unit area next to the unit area on which the second liquid has been landed, and wherein the first predetermined value is less than the second predetermined value.

3. The liquid ejection apparatus according to claim 2, wherein the controller is further configured to control the second-liquid ejection head such that an amount of the second liquid to be ejected from each of the second ejection openings increases with an increase in an amount of the first liquid to be ejected onto a corresponding one of the unit areas and such that the amount of the second liquid to be ejected from each of the second ejection openings does not exceed the first predetermined value.

4. The liquid ejection apparatus according to claim 2, wherein the plurality of second ejection openings comprise a plurality of pairs of the second ejection openings, wherein two second ejection openings of each of the plurality of pairs are arranged side by side in the main scanning direction, and wherein, in each of all the pairs of second ejection openings, the two second ejection openings are respectively arranged at different positions in the conveying direction.

5. The liquid ejection apparatus according to claim 2, wherein the plurality of second ejection openings are constituted by a plurality of second-ejection-opening groups, each ejection-opening group constituted by a plurality of the second ejection openings which are arranged at the same position in the conveying direction and which are arranged in a row in the main scanning direction, and wherein rows of the plurality of the second ejection openings of the second-ejection-opening groups are spaced apart from each other in the main scanning direction.

6. The liquid ejection apparatus according to claim 1, wherein the controller is further configured to obtain an evaluation value indicating an area in which dots of the second liquid are to be overlaid on each other on the pair of unit areas, on the basis of (a) a time difference between respective ejections of the second liquid from the pair of second ejection openings onto the pair of unit areas and (b) an amount of the second liquid to be ejected from at least one of the pair of second ejection openings, and wherein, when the evaluation value is equal to or greater than a third predetermined value, the controller is configured to reduce the amount of the second liquid to be ejected from the at least one of the pair of second ejection openings such that the evaluation value is less than the third predetermined value.

7. The liquid ejection apparatus according to claim 1, wherein the plurality of second ejection openings comprise two opposite-side second ejection openings which are two second ejection openings respectively next to the pair of second ejection openings and respectively located on opposite sides of the pair of second ejection openings in the main scanning direction, wherein the plurality of unit areas comprise two opposite-side unit areas respectively next to the pair of unit areas and respectively located on opposite sides of the pair of unit areas in the main scanning direction, wherein the controller is further configured to select one of the two opposite-side unit areas that is an area onto which of the second liquid is to be ejected by an amount less than that of the second liquid to be ejected onto the other of the two opposite-side unit areas, when one of the two opposite-side second ejection openings and one of the pair of second ejection openings which is next to the one opposite-side second ejection opening are formed at the same position in the conveying direction and when the other of the two opposite-side second ejection openings and the other of the pair of second ejection openings which is next to the other opposite-side second ejection opening are formed at the same position in the conveying direction, and wherein the controller is further configured reduce the amount of the second liquid to be ejected onto one of the pair of unit areas which is next to the opposite-side unit area selected by the controller.

8. The liquid ejection apparatus according to claim 1, wherein the plurality of second ejection openings comprise a first pair of the second ejection openings and a second pair of the second ejection openings, and both of the first pair and the second pair comprise the same one of the plurality of second ejection openings, wherein the controller is further configured to control the second-liquid ejection head such that when the second-liquid ejection head ejects the second liquid from the first pair and the second pair of the second ejection openings onto a plurality of unit areas which are contiguous to each other in the main scanning direction, second ejection openings from which the second liquid having a reduced amount is to be ejected are not next to each other in the main scanning direction.

9. The liquid ejection apparatus according to claim 1, wherein the controller is further configured not to when the controller reduces an amount of the second liquid to be ejected from one of the pair of second ejection openings onto one of a pair of unit areas arranged side by side in the conveying direction, reduce an amount of the second liquid to be ejected from the other of the pair of second ejection openings onto the other of the pair of unit area arranges side by side in the conveying direction.

10. A storage medium storing a program executed in a liquid ejection apparatus, the liquid ejection apparatus comprising:

a conveying mechanism configured to convey a recording medium in a predetermined conveying direction;

a storage device configured to store image data;

a first-liquid ejection head having a plurality of first ejection openings formed therein for ejecting a first liquid to form an image on the recording medium;

a second-liquid ejection head having a plurality of second ejection openings formed therein for ejecting a second liquid having a property of coagulating or precipitating components of the first liquid, the second-liquid ejection head being disposed upstream of the first-liquid ejection head in the conveying direction an amount of second liquid to be ejected from each of the plurality of second ejection openings being determined based on the image data; and a controller configured to control the first-liquid ejection head and the second-liquid ejection head, wherein the recording medium is separated into a plurality of unit areas along the conveying direction and a main scanning direction that is perpendicular to the conveying direction, the plurality of unit areas respectively corresponding to a plurality of pixels defined by a resolution of the image, the program comprising instruction for judging whether the determined amount of the second liquid to be ejected from an earlier-ejection opening of a pair of second ejection openings of the plurality of second ejection openings is equal to or greater than a first predetermined value, the pair of second ejection openings being constituted by the earlier-ejection opening and a later-ejection opening which are arranged side by side in the main scanning direction and arranged at different positions in the conveying direction, the second-liquid ejection head being configured to eject the second liquid from the earlier-ejection opening onto one of a pair of unit areas of the plurality of unit areas at an earlier timing than from the later-ejection opening onto the other of the pair of unit areas, the pair of unit areas being located at the same position in the conveying direction and arranged side by side in the main scanning direction; and determining an amount of the second liquid to be ejected from the earlier-ejection opening for which the controller has judged that the determined amount of the second liquid is equal to or greater than the first predetermined value, to an amount smaller than the first predetermined value and determine an amount of the second liquid to be ejected from the later-ejection opening, to an amount that is determined based on the image data for the other of the pair of unit areas.

11. A storage medium storing a program executed in a liquid ejection apparatus, the liquid ejection apparatus:

a conveying mechanism configured to convey a recording medium in a predetermined conveying direction;

a storage device configured to store image data a first-liquid ejection head having a plurality of first ejection openings formed therein for ejecting a first liquid to form an image on the recording medium;

a second-liquid ejection head having a plurality of second ejection openings formed therein for ejecting a second liquid having a property of coagulating or precipitating components of the first liquid, the second-liquid ejection head being disposed upstream of the first-liquid ejection head in the conveying direction, an amount of second liquid to be ejected from each of the plurality of second ejection openings is determined based on the image data; and a controller configured to control the first-liquid ejection head and the second-liquid ejection head, wherein the recording medium is separated into a plurality of unit areas along the conveying direction and a perpendicular main scanning direction that is perpendicular to the conveying direction, the plurality of unit areas respectively corresponding to a plurality of pixels defined by a resolution of the image, and the program comprising instruction for judging an amount of the second liquid to be ejected from an earlier-ejection opening of a pair of second ejection openings of the plurality of second ejection openings is equal to or greater than a first predetermined value;

judging whether the determined amount of the second liquid to be ejected from a later-ejection opening of the pair of second ejection openings is equal to or greater than a second predetermined value, the earlier-ejection opening and the later-ejection opening being arranged side by side in the main scanning direction and arranged at different positions in the conveying direction, the second-liquid ejection head being configured to eject the second liquid from the earlier-ejection opening onto one of a pair of unit areas of the plurality of unit areas at an earlier timing than from the later-ejection opening onto the other of the pair of unit areas, the pair of unit areas being located at the same position in the conveying direction and arranged side by side in the main scanning direction; and determining an amount of the second liquid to be ejected from the earlier-ejection opening for which the controller has judged that the determined amount of the second liquid is equal to or greater than the first predetermined value, to an amount smaller than the first predetermined value and determining an amount of the second liquid to be ejected from the later-ejection opening for which the controller has judged that the determined amount of the second liquid is equal to or greater than the second predetermined value, to an amount smaller than the second predetermined value, wherein the first predetermined value is an amount of the second liquid in which, at a time when or after the second liquid has been landed on one of the unit areas, the second liquid does not reach another unit area next to the unit area on which the second liquid has been landed, wherein the second predetermined value is an amount of the second liquid in which, at a time when the second liquid has been landed on one of the unit areas, the second liquid does not reach another unit area next to the unit area on which the second liquid has been landed, and wherein the first predetermined value is less than the second predetermined value.

* * * * *